US009728862B2

(12) United States Patent
Choi et al.

(10) Patent No.: US 9,728,862 B2
(45) Date of Patent: Aug. 8, 2017

(54) METHOD AND APPARATUS FOR BEAMFORMING

(71) Applicants: Samsung Electronics Co., Ltd, Gyeonggi-do (KR); KOREA ADVANCED INSTITUTE OF SCIENCE AND TECHNOLOGY, Daejeon (KR)

(72) Inventors: Won-Suk Choi, Gyeonggi-do (KR); Chul-Soon Park, Daejeon (KR); In-Sang Song, Daejeon (KR); Inn-Yeal Oh, Daejeon (KR); Joong-Ho Lee, Daejeon (KR); Chae-Jun Lee, Daejeon (KR)

(73) Assignees: KOREA ADVANCED INSTITUTE OF SCIENCE AND TECHNOLOGY, Daejeon (KR); SAMSUNG ELECTRONICS CO., LTD, Suwon-si, Gyeonggi-Do (KR)

( * ) Notice: Subject to any disclaimer, the term of this patent is extended or adjusted under 35 U.S.C. 154(b) by 38 days.

(21) Appl. No.: 14/101,172

(22) Filed: Dec. 9, 2013

(65) Prior Publication Data

US 2014/0225794 A1 Aug. 14, 2014

(30) Foreign Application Priority Data

Dec. 7, 2012 (KR) ..... 10-2012-0141974

(51) Int. Cl.
*H01Q 19/30* (2006.01)
*H01Q 3/01* (2006.01)
(Continued)

(52) U.S. Cl.
CPC ..... *H01Q 19/30* (2013.01); *H01Q 3/00* (2013.01); *H01Q 3/01* (2013.01); *H01Q 1/246* (2013.01); *H01Q 3/24* (2013.01)

(58) Field of Classification Search
CPC ..... H01Q 5/49; H01Q 19/30; H01Q 9/36
(Continued)

(56) References Cited

U.S. PATENT DOCUMENTS 4,186,400 A 1/1980 Cermignani et al.
4,700,197 A * 10/1987 Milne ..... H01Q 3/446 343/837
(Continued)

FOREIGN PATENT DOCUMENTS

CN 1656646 A 5/2007
CN 101499559 A 8/2009
(Continued)

OTHER PUBLICATIONS

Zhao et al. Reconfigurable Yagi-Uda Substrate for Radar Cross Section Reduction of Patch Antenna, Progress in Electromagnetics Research B, vol. 11, 173-187, 2009.*
(Continued)

*Primary Examiner* — Dieu H Duong
*Assistant Examiner* — Bamidele A Jegede

(57) ABSTRACT

A wireless communication system provides an antenna apparatus for the wireless communication system. The antenna apparatus includes a base, a plurality of Yagi-Uda antenna modules disposed in a specific arrangement, a plurality of floating metal modules correspondingly installed in upper portions of the Yagi-Uda antenna modules and selectively connected to a corresponding Yagi-Uda module among the plurality of Yagi-Uda antenna modules, a switching element for selectively switching the floating metal module and the Yagi-Uda antenna module, and a controller for controlling the Yagi-Uda antenna module to comprise a directivity in a desired direction by selectively switching the switching element.

16 Claims, 27 Drawing Sheets

(51) Int. Cl.
*H01Q 3/00* (2006.01)
*H01Q 1/24* (2006.01)
*H01Q 3/24* (2006.01)

(58) Field of Classification Search
USPC ..... 343/817, 757
See application file for complete search history.

(56) References Cited

U.S. PATENT DOCUMENTS

| | | | | |
|---|---|---|---|---|
| 5,767,807 | A * | 6/1998 | Pritchett | H01Q 3/24 342/374 |
| 6,317,092 | B1 * | 11/2001 | de Schweinitz | H01Q 3/242 343/753 |
| 6,337,668 | B1 * | 1/2002 | Ito | H01Q 3/24 343/833 |
| 6,404,401 | B2 * | 6/2002 | Gilbert | H01Q 1/38 343/777 |
| 6,515,634 | B2 * | 2/2003 | Desclos | H01Q 3/12 343/818 |
| 7,088,306 | B2 * | 8/2006 | Chiang | H01Q 1/246 343/810 |
| 7,268,738 | B2 * | 9/2007 | Gothard | H01Q 3/446 343/702 |
| 7,274,330 | B2 * | 9/2007 | Lee | H01Q 1/40 342/374 |
| 7,636,070 | B2 * | 12/2009 | De Lustrac | H01Q 3/446 343/833 |
| 7,656,360 | B2 * | 2/2010 | Hirabayashi | H01Q 3/44 343/818 |
| 2007/0103377 | A1 | 5/2007 | Abramov et al. | |
| 2007/0229357 | A1 * | 10/2007 | Zhang | H01Q 3/24 343/700 MS |
| 2011/0063181 | A1 * | 3/2011 | Walker | H01Q 9/16 343/803 |
| 2011/0102287 | A1 | 5/2011 | Noguchi et al. | |

FOREIGN PATENT DOCUMENTS

| | | | | |
|---|---|---|---|---|
| DE | WO 2004102742 | A1 * | 11/2004 | H01Q 1/3275 |
| FI | EP 2077604 | A1 * | 7/2009 | H01Q 19/30 |
| GB | WO 2011117621 | A2 * | 9/2011 | |
| JP | 06-069723 | | 3/1994 | |
| JP | 2009-094696 | | 4/2009 | |
| JP | 2009094696 | * | 4/2009 | H01Q 3/44 |
| KR | 10-2004-045242 | | 6/2004 | |
| KR | 10-2005-0004043 | | 1/2005 | |
| WO | WO 2011053431 | A1 * | 5/2011 | H01Q 3/44 |

OTHER PUBLICATIONS

International Search Report dated Mar. 20, 2014 in connection with International Application No. PCT/KR2013/011156, 3 pages.

Written Opinion of International Searching Authority dated Mar. 20, 2014 in connection with International Application No. PCT/KR2013/011156, 7 pages.

S.C. Zhao et al., "Reconfigurable Yagi-Uda Substrate for RCS Reduction of Patch Antenna", Progress in Electromagnetics Research B., 2009, vol. 11, pp. 173-187.

State Intellectual Property Office of the P.R.C., "First Office Action," Application No. 201380063589.3, Dec. 9, 2016, 9 pages, publisher SIPO, Beijing Shi, China.

* cited by examiner

| Name | Phj | Ang | Mag |
|---|---|---|---|
| m1 | 40.0000 | 40.0000 | 7.4071 |
| m2 | 78.0000 | 78.0000 | 4.5276 |
| m3 | 2.0000 | 2.0000 | 4.5375 |

| Name | Phi | Ang | Mag |
|---|---|---|---|
| m1 | 120.0000 | 120.0000 | 7.3873 |
| m2 | 158.0000 | 158.0000 | 4.4624 |
| m4 | 82.0000 | 82.0000 | 4.4725 |

| Name | Phj | Ang | Mag |
|---|---|---|---|
| m1 | 240.0000 | −120.0000 | 7.8624 |
| m2 | 204.0000 | −158.0000 | 4.8434 |
| m3 | 278.0000 | −82.0000 | 4.8461 |

| Name | Phj | Ang | Mag |
|---|---|---|---|
| m1 | 320.0000 | −40.0000 | 7.5112 |
| m2 | 281.0000 | −79.0000 | 4.5854 |
| m3 | 358.0000 | −2.0000 | 4.4625 |

3D − Beampattern

| Name | Phj | Ang | Mag |
|---|---|---|---|
| m1 | 75.0000 | 75.0000 | 11.0630 |
| m2 | 58.0000 | 58.0000 | 8.1317 |
| m3 | 92.0000 | 92.0000 | 8.2726 |

| Name | Phj | Ang | Mag |
|---|---|---|---|
| m1 | 263.0000 | −107.0000 | 11.1064 |
| m2 | 273.0000 | −87.0000 | 8.0191 |
| m3 | 238.0000 | −122.0000 | 8.3906 |

| Name | Phj | Ang | Mag |
|---|---|---|---|
| m1 | 345.0000 | −15.0000 | 11.2070 |
| m2 | 327.0000 | −33.0000 | 8.1625 |
| m3 | 3.0000 | 3.0000 | 8.3839 |

| Name | Phj | Ang | Mag |
|---|---|---|---|
| m1 | 85.0000 | 85.0000 | 17.4871 |
| m2 | 76.0000 | 75.0000 | 14.6061 |
| m3 | 94.0000 | 94.0000 | 14.5464 |
| m4 | 46.0000 | 46.0000 | 2.0540 |
| m5 | 21.0000 | 21.0000 | 2.6453 |

3D - Beampattern

| Name | Phj | Ang | Mag |
|---|---|---|---|
| m1 | 87.0000 | 87.0000 | 17.1510 |
| m2 | 81.0000 | 81.0000 | 14.4265 |
| m3 | 94.0000 | 94.0000 | 14.4458 |
| m4 | 269.0000 | −91.0000 | 4.6900 |

METHOD AND APPARATUS FOR BEAMFORMING

PRIORITY

The present application is related to and claims the benefit under 35 U.S.C. §119(a) of a Korean patent application filed in the Korean Intellectual Property Office on Dec. 7, 2012 and assigned Serial No. 10-2012-0141974, the entire disclosure of which is hereby incorporated by reference.

TECHNICAL FIELD

The present disclosure relates to a wireless communication system.

BACKGROUND

A Beam Division Multiple Access (BDMA) system is a system for providing a spatial multiplexing gain in such a manner that a spatial selectivity is provided by forming a directional beam other than the existing omni-directional beam between base stations (BSs) or between a BS and a user equipment (UE), Regarding the spatial selectivity which utilizes the directional beam, one of important issues is a half-power beam width which corresponds to an angle at which an antenna gain is decreased by half against a maximum antenna gain, and is closely related to the number of array antennas.

When the directional beam is utilized in wireless communication, an antenna gain varies depending on a location of a transmitter/receiver, which is directly related to a Signal to Noise Ratio (SNR). That is, the transmitter/receiver may be spatially located within a specific range (in general, a half-power beam width) in order to satisfy the SNR to maintain communication.

Accordingly, a beam-forming technique in which the transmitter/receiver can form a beam in a mutually desired direction is required in the BDMA system which may utilize a directional beam and perform communication (from a BS to a UE or from one BS to another BS) between various transmitters/receivers located in unspecified locations.

An Array Factor (AF) which represents a spatial size distribution of a beam is a function of a delay size of a signal flowing through an antenna and an incident direction of a received signal. Therefore, the beam can be formed in a desired direction by regulating a delay of the signal. An element for performing such a function is a phase shifter.

If the phase shifter is an element for determining a direction of the beam, a factor of determining a beam shape (i.e., null, beam width, and the like) is a size of a signal which flows through each antenna. The size of the signal is regulated by using a Variable Gain Amplifier (VGA).

For example, since a size distribution of a signal can include a binomial distribution by using the VGA, it is possible to form a beam that does not include a side lobe, that is, a beam which is not radiated in a direction other than that of a main beam among directional horizontal patterns of an antenna.

However, in a normal case, due to non-ideal performance of the phase shifter, the VGA takes a role of correcting a size difference of the signal which flows through each antenna.

Accordingly, there is a need to utilize the array antenna, the phase shifter, and the VGA in order to maintain communication between fixed/mobile transmitters/receivers which include a spatial selectivity in the BDMA system.

The biggest problem occurring when the aforementioned beam-forming technique is applied to meet the purpose of the BDMA system lies in that a complexity of the system is significantly increased to form multiple beams.

The BDMA system utilizes multiple beams to increase a channel capacity by using a spatial selectivity. In order to generate and operate the multiple beams, a beam-forming system including an array antenna corresponding to each beam is required.

As described above, the beam-forming system requires a phase shifter for regulating a direction of a beam, a VGA for compensating for a gain (or loss) error of the phase shifter, and a power combiner/distributor for combining/distributing a plurality of signals. In addition, in order to reliably operate a plurality of circuits within a signal path, a circuit for monitoring and correcting the operation is additionally required.

As a result, a system complexity is increased, which causes a problem of increasing a system cost and increasing a system error rate. Accordingly, for the BDMA system, there is a need to develop a technique which can perform beam-forming with a much simpler structure.

SUMMARY

To address the above-discussed deficiencies, it is a primary object to provide a beam-forming method and apparatus.

Another aspect of the present disclosure is to provide a method and apparatus for simplifying a complex structure of a system using an array antenna used to include a spatial selectivity in a Beam Division Multiple Access (BDMA) system.

In accordance with one aspect of the present disclosure, an antenna apparatus for a wireless communication system is provided. The antenna apparatus includes a base, a plurality of Yagi-Uda antenna modules disposed in a specific arrangement, a plurality of floating metal modules correspondingly installed in upper portions of the Yagi-Uda antenna modules and selectively connected to a corresponding Yagi-Uda module among the plurality of Yagi-Uda antenna modules, a switching element for selectively switching the floating metal module and the Yagi-Uda antenna module, and a controller for controlling the Yagi-Uda antenna module to include a directivity in a desired direction by selectively switching the switching element.

In accordance with another aspect of the present disclosure, a method of controlling a beam for a wireless communication system is provided. The method includes determining a direction and width of the beam, bringing a reflector and director, not corresponding to the direction and width of the beam to be radiated, in contact with a floating metal by using a switch, and providing a signal to a radiator.

Before undertaking the DETAILED DESCRIPTION below, it may be advantageous to set forth definitions of certain words and phrases used throughout this patent document: the terms "include" and "comprise," as well as derivatives thereof, mean inclusion without limitation; the term "or," is inclusive, meaning and/or; the phrases "associated with" and "associated therewith," as well as derivatives thereof, may mean to include, be included within, interconnect with, contain, be contained within, connect to or with, couple to or with, be communicable with, cooperate with, interleave, juxtapose, be proximate to, be bound to or with, have, have a property of, or the like; and the term "controller" means any device, system or part thereof that controls at least one operation, such a device may be implemented in hardware, firmware or software, or some combination of at least two of the same. It should be noted that the functionality associated with any particular controller may be centralized or distributed, whether locally or remotely. Definitions for certain words and phrases are provided throughout this patent document, those of ordinary skill in the art should understand that in many, if not most instances, such definitions apply to prior, as well as future uses of such defined words and phrases.

BRIEF DESCRIPTION OF THE DRAWINGS

For a more complete understanding of the present disclosure and its advantages, reference is now made to the following description taken in conjunction with the accompanying drawings, in which like reference numerals represent like parts.

DETAILED DESCRIPTION

Figure 1B:
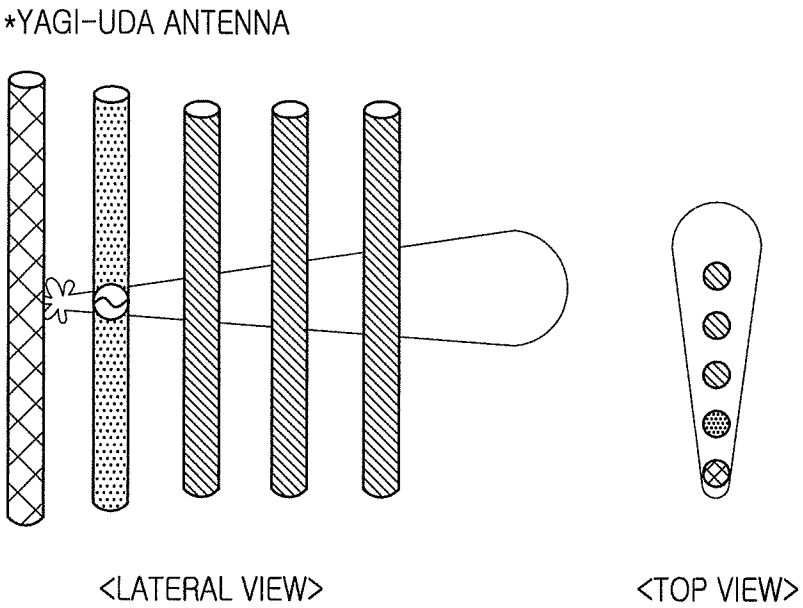
FIG. 1A and FIG. 1B illustrate a first diagram of a basic structure of a Yagi-Uda antenna according to an example embodiment of the present disclosure.

FIGS. 1 through 27, discussed below, and the various embodiments used to describe the principles of the present disclosure in this patent document are by way of illustration only and should not be construed in any way to limit the scope of the disclosure. Those skilled in the art will understand that the principles of the present disclosure may be implemented in any suitably arranged method and systems. Example embodiments of the present disclosure will be described herein below with reference to the accompanying drawings. In the following description, well-known functions or constructions are not described in detail since they would obscure the disclosure in unnecessary detail. Also, the terms used herein are defined according to the functions of the present disclosure. Thus, the terms may vary depending on user's or operator's intention and usage. That is, the terms used herein may be understood based on the descriptions made herein. Further, like reference numerals denote parts performing similar functions and actions throughout the drawings.

Hereinafter, a beam-forming method and apparatus will be described.

The present disclosure relates to a method and apparatus for supporting communication between Base Stations (BSs) and communication between a BS and a User Equipment (UE) by using a super high frequency in a Beam Division Multiple Access (BDMA) system.

Figure 1A:
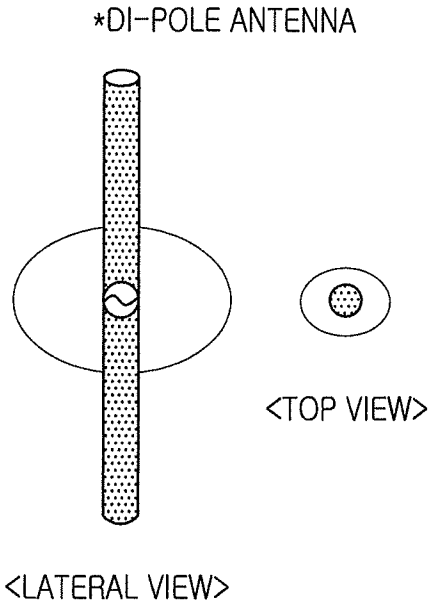

FIG. 1A and FIG. 1B illustrate a first diagram of a basic structure of a Yagi-Uda antenna according to an example embodiment of the present disclosure.

Referring to FIG. 1A, a di-pole antenna is illustrated. As a resonant-type antenna, the di-pole antenna provides a signal is radiated omni-directionally. Examples of modification of the di-pole antenna may include a mono-pole antenna and a Yagi-Uda antenna.

Referring to FIG. 1B, a Yagi-Uda antenna is illustrated. As a resonant-type antenna, the Yagi-Uda antenna provides directivity. The Yagi-Uda antenna will be described below in detail with reference to FIG. 2.

Figure 2:
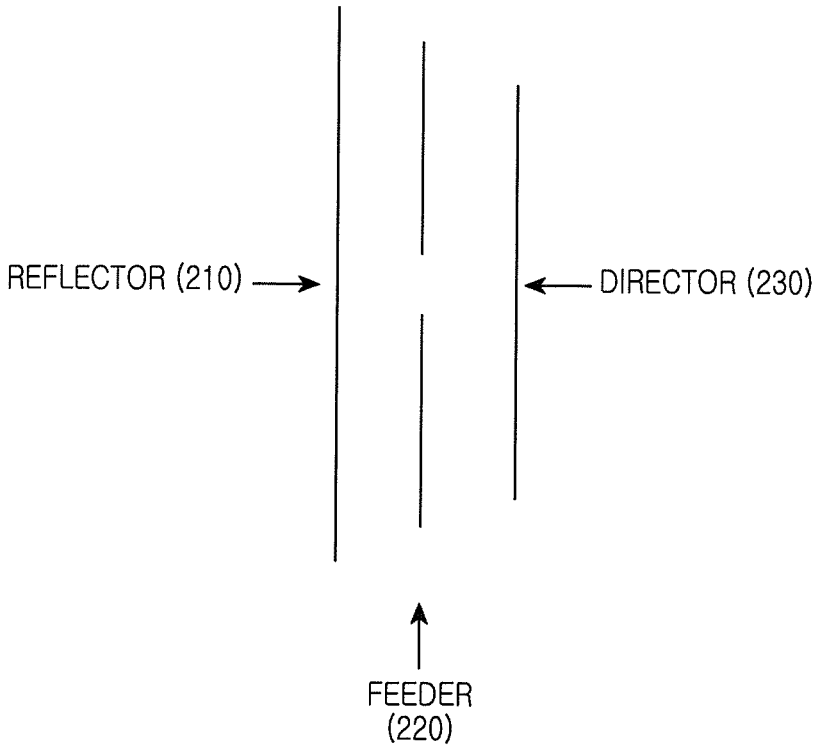
FIG. 2 illustrates a second diagram of a Yagi-Uda antenna according to an example embodiment of the present disclosure.

FIG. 2 illustrates a second diagram of a Yagi-Uda antenna according to an example embodiment of the present disclosure.

Referring to FIG. 2, the Yagi-Uda antenna consists of three elements. That is, the Yagi-Uda antenna consists of a feeder 220 for performing feeding and two parasitic elements, i.e., reflectors 210 and a director 230. The feeder 220, the reflector 210, and the director 230 may also be respectively called a radiator element, a reflector element, and a director element.

Since the reflector 210 is longer in length than the feeder 220 and the reflector 210 is greater in size than a resonant length, its impedance becomes inductive. Alternatively, the director 230 is smaller in size than the resonant length and thus its impedance becomes capacitive.

When the reflector 210, the feeder 220, and the director 230 are arranged while maintaining a specific distance as described above, a beam is formed in a direction of the director 230. A beam pattern and a gain differ depending on a change in the number of directors 230 and a distance between elements, i.e., a length of each element.

Figure 3:
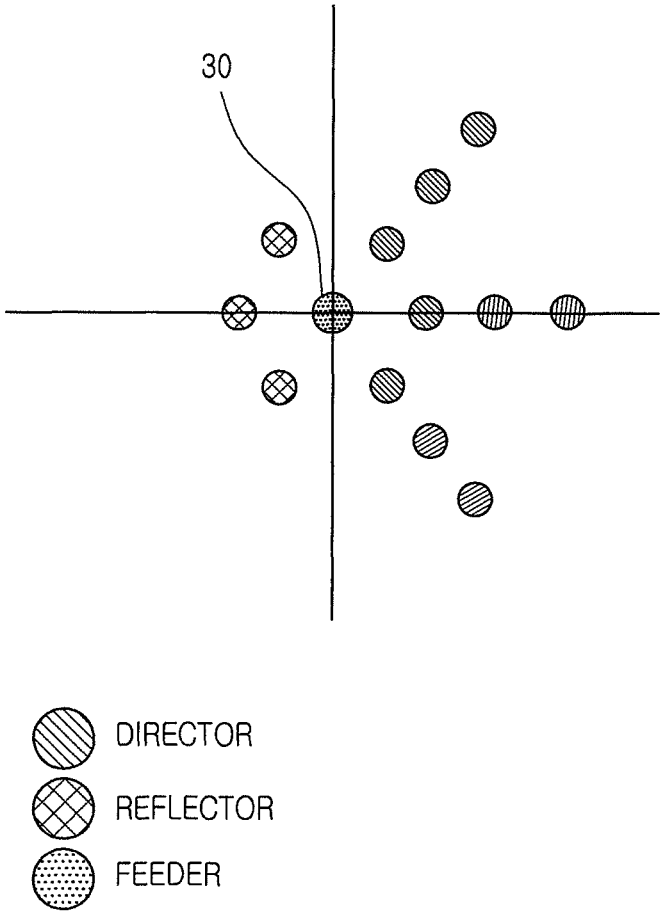
FIG. 3 illustrates a diagram of an arrangement of a plurality of Yagi-Uda antennas according to an example embodiment of the present disclosure.

FIG. 3 illustrates a diagram of an arrangement of a plurality of Yagi-Uda antennas according to an example embodiment of the present disclosure.

Referring to FIG. 3, Yagi-Uda antennas arranged in three directions include a structure in which a feeder is located in a center portion 30 such that the Yagi-Uda antenna of each direction shares the feeder. Herein, each element includes an interval of 0.2λ. In this case, three directors exist, and a reflector exists in a direction facing the directors with the feeder as its center.

Figure 4:
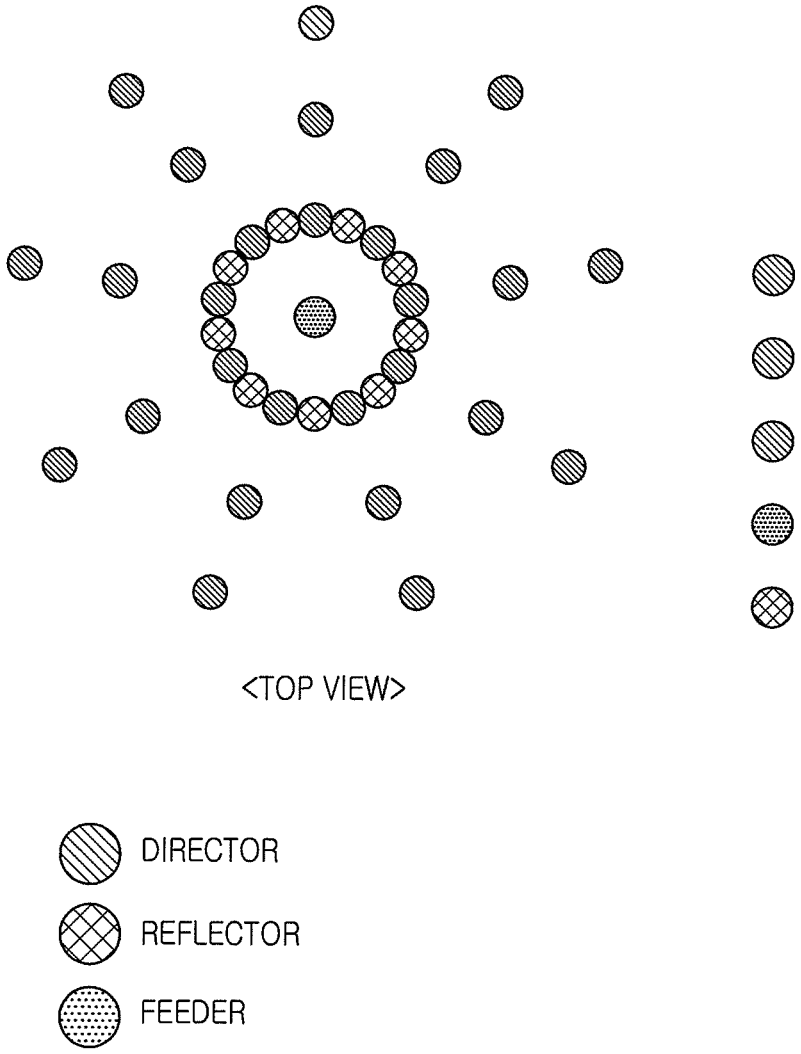
FIG. 4 illustrates a first diagram of a beam-forming system using a Yagi-Uga antenna according to an example embodiment of the present disclosure.

FIG. 4 illustrates a first diagram of a beam-forming system using a Yagi-Uga antenna according to an example embodiment of the present disclosure.

Referring to FIG. 4, the Yagi-Uda antenna is illustrated in an X-Y plane. In this structure, a reflector, a feeder, and a director stand upwardly. In the structure of FIG. 4, the Yagi-Uda antenna is arranged in 360 degrees such that a beam can be generated omni-directionally.

The Yagi-Uda antenna may be installed in a base. The base is constructed of a dielectric material, and thus can combine a plurality of Yagi-Uda antennas.

Figure 5:
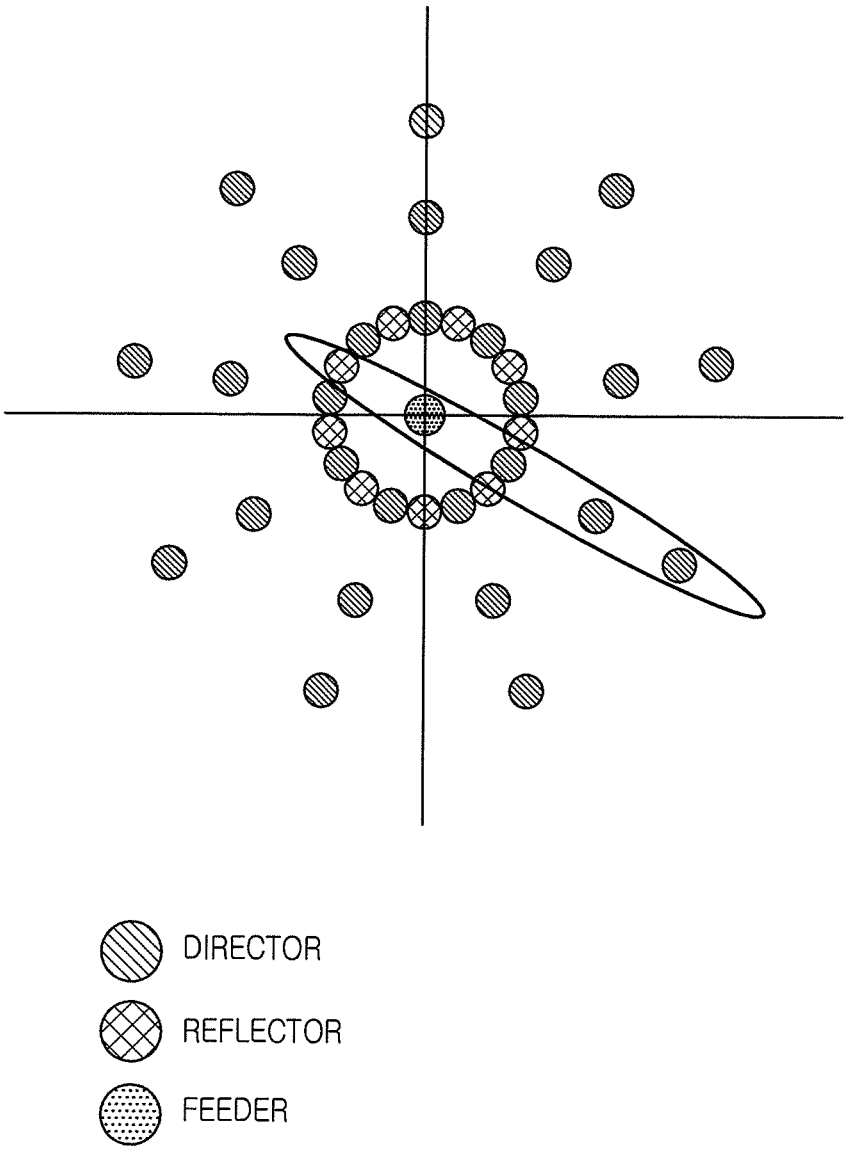
FIG. 5 illustrates a second diagram of a beam-forming system using a Yagi-Uda antenna according to an example embodiment of the present disclosure.

FIG. 5 illustrates a second diagram of a beam-forming system using a Yagi-Uda antenna according to an example embodiment of the present disclosure.

Referring to FIG. 5, there is one Yagi-Uda antenna in a beam-forming system using the Yagi-Uda antenna of FIG. 4.

As described above, the Yagi-Uda antenna basically consists of a reflector, a director, and a feeder. The above elements consist of linear di-pole elements. Among the elements, the feeder is supplied with energy directly through a feeding transmission line, and the remaining elements are mutually combined with each other and operate as parasitic elements in which an electric current is generated. In addition, the remaining elements are affected in performance by a length and interval between the directors.

Elements separated from the feeder that includes a shorter length than a resonant length lake a role of strengthening an electric field generated towards the director, and the reflector performs an opposite role.

That is, the reflector is driven by a first element located very next to a feeding element (i.e., feeder). Even if one or more reflectors are arranged, performance is not much affected.

However, the performance can be improved if the number of directors is increased. Even though the directors are continuously arranged, there is a limitation in the increase in the performance instead of being continuously increased. This is because an induced electric current is decreased in size.

Figure 6:
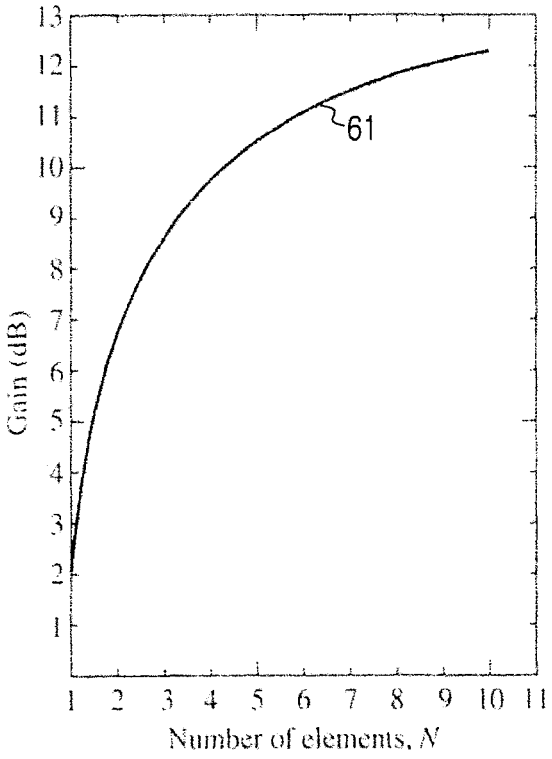
FIG. 6 illustrates a graph of a relation between a gain and the number of directors in a beam-forming system using a Yagi-Uda antenna according to an example embodiment of the present disclosure.

FIG. 6 illustrates a graph of a relation between a gain and the number of directors in a beam-forming system using a Yagi-Uda antenna according to an example embodiment of the present disclosure.

Referring to FIG. 6, if the number of directors is increased to up to 5-6, the gain 61 is significantly increased whenever the number of directors is increased, whereas if the number of directors is increased to more than that, the increase of the gain is limited.

In the Yagi-Uda antenna according to the example embodiment of the present disclosure, copper is generally used as a physical material of a reflector, a feeder, and a director, but it is apparent that the material thereof is not limited thereto.

In addition, in the Yagi-Uda antenna according to the example embodiment of the present disclosure, a length, diameter, and interval of the reflector, feeder, and direction are summarized by the following table.

TABLE 1

| the feeder of each element = 0.0085λ the distance of the reflector = 0.2λ | | a Total distance of the Yagi-Uda antenna 0.4 | 0.8 | 1.20 | 2.2 | 3.2 | 4.2 |
|---|---|---|---|---|---|---|---|
| the length of the reflector | | 0.482 | 0.482 | 0.482 | 0.482 | 0.482 | 0.475 |
| the length of the director | D1 | 0.442 | 0.428 | 0.428 | 0.432 | 0.428 | 0.424 |
| | D2 | | 0.424 | 0.420 | 0.415 | 0.420 | 0.424 |
| | D3 | | 0.428 | 0.420 | 0.407 | 0.407 | 0.420 |
| | D4 | | | 0.428 | 0.398 | 0.398 | 0.407 |
| | D5 | | | | 0.390 | 0.394 | 0.403 |
| | D6 | | | | 0.390 | 0.390 | 0.398 |
| | D7 | | | | 0.390 | 0.386 | 0.394 |
| | D8 | | | | 0.390 | 0.386 | 0.390 |
| | D9 | | | | 0.398 | 0.386 | 0.390 |
| | D10 | | | | 0.407 | 0.386 | 0.390 |
| | D11 | | | | | 0.386 | 0.390 |
| | D12 | | | | | 0.386 | 0.390 |
| | D13 | | | | | 0.386 | 0.390 |
| | D14 | | | | | 0.386 | |
| | D15 | | | | | 0.386 | |
| The distance of the director | | 0.2 | 0.2 | 0.25 | 0.2 | 0.2 | 0.308 |
| Gain relative to half-wave dipole, dB | | 7.1 | 9.2 | 10.2 | 12.25 | 13.4 | 14.2 |

Referring to Table 1 above, it is illustrated a length of the reflector and a length of the director when the number of directors is "1" to "15". Herein, a length of the feeder is shorter than the length of the reflector and is longer than the length of the director.

The Yagi-Uda antenna can be mathematically explained by the following equation on the basis of a Pocklington's integral equation for a whole electric field generated by an electric current source radiated in a free space.

$$\int_{-l/2}^{+l/2} I(z')\left(\frac{\partial^2}{\partial z^2}+k^2\right)\frac{e^{jkR}}{R}dz' = j4\pi\omega\varepsilon_0 E_z^t, \text{ where} \tag{1}$$

$$R=\sqrt{(x-x')^2+(y-y')^2+(z-z)^2},$$

$$\frac{\partial^2}{\partial z^2}\left(\frac{e^{jkR}}{R}\right)=\frac{\partial^2}{\partial z'^2}\left(\frac{e^{jkR}}{R}\right)$$

The following equation is derived by using the relation of Equation (1) above.

$$\int_{-l/2}^{+l/2} I(z')\frac{\partial^2}{\partial z^2}\left(\frac{e^{-jkR}}{R}\right)dz' + k^2\int_{-l/2}^{+l/2} I(z')\frac{e^{-jkR}}{R}dz' = j4\pi\omega\varepsilon_0 E_z^t \tag{2}$$

When a first term of Equation (2) above is developed by applying a partial integration, the following equation is obtained.

$$u = I(z') \tag{3}$$

$$du = \frac{dI(z')}{dz'}dz'$$

$$dv = \frac{\partial^2}{\partial z'^2}\left(\frac{e^{-jkR}}{R}\right)dz' = \frac{\partial}{\partial z'}\left[\frac{\partial}{\partial z'}\left(\frac{e^{-jkR}}{R}\right)\right]dz'$$

$$v = \frac{\partial}{\partial z'}\left(\frac{e^{-jkR}}{R}\right)$$

$$\int_{-l/2}^{+l/2} I(z')\frac{\partial^2}{\partial z'^2}\left(\frac{e^{-jkR}}{R}\right)dz' = I(z')\left[\frac{\partial}{\partial z'}\left(\frac{e^{-jkR}}{R}\right)\right]_{-l/2}^{+l/2} - \int_{-l/2}^{+l/2}\frac{\partial}{\partial z'}\left(\frac{e^{-jkR}}{R}\right)\frac{dI(z')}{dz'}dz$$

Since an electric current may be zero at the end of each conductive line, Equation (3) above is the same as the following equation.

$$\int_{-l/2}^{+l/2} I(z')\frac{\partial^2}{\partial z'^2}\left(\frac{e^{-jkR}}{R}\right)dz' = -\int_{-l/2}^{+l/2}\frac{\partial}{\partial z'}\left(\frac{e^{-jkR}}{R}\right)dz'\frac{dI(z')}{dz'} \tag{4}$$

Equation (4) above is partially integrated as follows.

$$u = \frac{dI(z')}{dz'} \tag{5}$$

$$du = \frac{d^2I(z')}{dz'^2}dz'$$

$$dv = \frac{\partial}{\partial z'}\left(\frac{e^{-jkR}}{R}\right)dz'$$

$$v = \frac{e^{-jkR}}{R}$$

$$\int_{-l/2}^{+l/2} I(z')\frac{\partial^2}{\partial z'^2}\left(\frac{e^{-jkR}}{R}\right)dz' =$$

-continued $$-\frac{dI(z')}{dz'}\frac{e^{-jkR}}{R}\Bigg|_{-l/2}^{+l/2} + \int_{-l/2}^{+l/2}\frac{d^2I(z')}{dz'^2}\frac{e^{-jkR}}{R}dz'$$

Equation (5) above is combined as shown in Equation (6) below.

$$-\frac{dI(z')}{dz'}\frac{e^{-jkR}}{R}\Bigg|_{-l/2}^{+l/2} + \int_{-l/2}^{+l/2}\left[k^2I(z')+\frac{d^2I(z')}{dz'^2}\right]\frac{e^{-jkR}}{R}dz' = j4\pi\omega\varepsilon_0 E_z^t \tag{6}$$

In a conductive line with a small diameter, an electric current at each element can be approximated as a finite series for an even mode of an odd order, and an electric current at an $n^{th}$ element can be used as an extension of a Fourier series that includes a format shown in the following equation.

$$I_n(z') = \sum_{m=1}^{M} I_{nm}\cos\left[(2m-1)\frac{\pi z'}{l_n}\right] \tag{7}$$

Herein, $I_{nm}$ denotes a complex-valued electric current coefficient of a mode m for an element n, and $l_n$ denotes a corresponding length of an $n^{th}$ element. If Equation (7) above is subjected to first and second order differentiations and is then substituted to the Equation (6), the following equation is obtained.

$$\sum_{m=1}^{M} I_{nm}\left\{\frac{(2m-1)\pi}{l_n}\sin\left[(2m-1)\frac{\pi z_n'}{l_n}\right]\frac{e^{-jkR}}{R}\Bigg|_{-l/2}^{+l/2} + \left[k^2-\frac{(2m-1)^2\pi^2}{l_n^2}\right]\times \int_{-l_n/2}^{+l_n/2}\cos\left[(2m-1)\frac{\pi z_n'}{l_n}\right]\frac{e^{-jkR}}{R}dz_n'\right\} = j4\pi\omega\varepsilon_0 E_z^t \tag{8}$$

Herein, since a cosine function is an even function, it is enough to perform integration only in $0 \le z' \le l/2$, and thus the equation above is expressed by the following equation.

$$\sum_{m=1}^{M} I_{nm}\left\{(-1)^{m-1}\frac{(2m-1)\pi}{l_n}G_2\left(x, x', y, y' lz, \frac{l_n}{2}\right) + \left[k^2-\frac{(2m-1)^2\pi^2}{l_n^2}\right]\times\int_0^{l_n/2} G_2\left(x, x', y, y' lz, \frac{l_n}{2}\right)\cos\left[\frac{(2m-1)\pi z_n'}{l_n}\right]dz_n'\right\}_z^t = j4\pi\omega\varepsilon_0 E \tag{9}$$

Herein, $G_2\left(x, x', y, y' lz, \frac{l_n}{2}\right) = \frac{e^{-jkR_-}}{R_-} + \frac{e^{-jkR_+}}{R_+}$, and $$R_\pm = \sqrt{(x-x')^2+(y-y')^2+a^2+(z\pm z')^2}.$$

Figure 7:
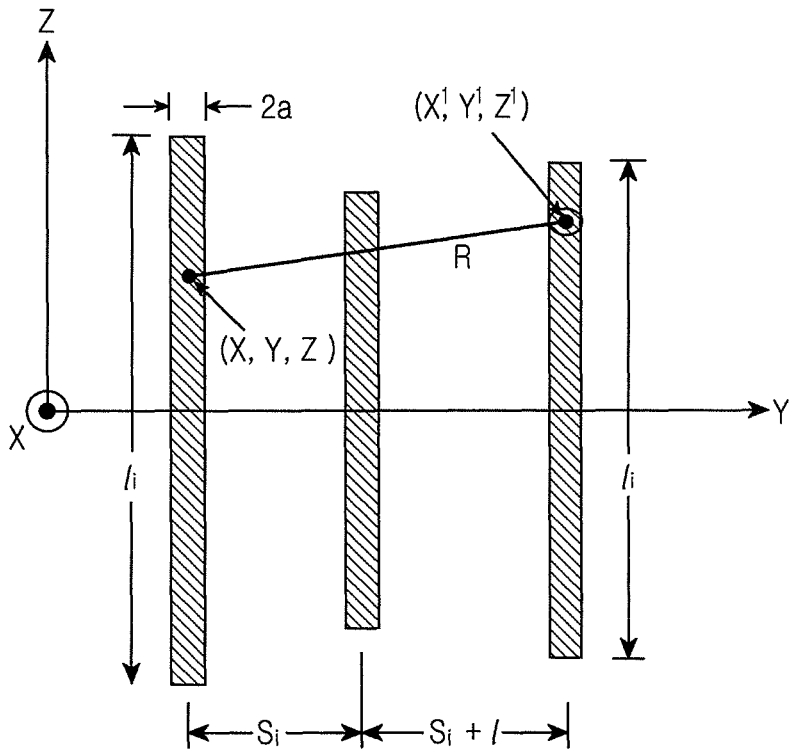
FIG. 7 illustrates a distance from a center of each conductive line to a center of another line according to an example embodiment of the present disclosure.

Herein, N denotes the total number of elements. In addition, $R_\pm$ denotes a distance from a center of each conductive line to a center of another line as illustrated in FIG. 7.

If it is assumed that an integral equation is effective for each element and if the number M of electric current modes is equal to the number of respective elements, each element may be divided into M parts. Herein, if an electric current distribution is obtained, a long-distance electric field generated by each element can be obtained by adding a contribution part from each element.

The long-distance electric field generated by an M mode of an nth element which is in parallel with a Z-axis is as shown the following equation.

$$E_{\theta n} = -j\omega A_{\theta n} \tag{10}$$

$$A_{\theta n} = -\frac{\mu e^{-jkr}}{4\pi r}\sin\theta\int_{-l_n/2}^{+l_n/2} I_n e^{-jk(x_n\sin\theta\cos\phi+y_n\sin\theta\sin\phi+z_n\cos\theta)}dz_n'\theta$$
$$= -\frac{\mu e^{jkr}}{4\pi r}\sin\left[e^{jk(x_n\sin\theta\cos\phi+y_n\sin\theta\sin\phi)}\int_{-l_n/2}^{+l_n/2} I_n e^{-jkz_n'\cdot\cos\theta}dz_n'\right]$$

Herein, $x_n$ and $y_n$ denote a location of an nth element. Therefore, a whole electric field is obtained as expressed in the following equation by adding a contribution part from each of N elements.

$$E_\theta = \sum_{n=1}^{N} E_{\theta n} = -j\omega A_{\theta n} \tag{11}$$

$$A_{\theta n} = \sum_{n=1}^{N} A_{\theta n} =$$
$$-\frac{\mu e^{-jkr}}{4\pi r}\sin\theta\sum_{n=1}^{N}\left\{e^{jk(x_n\sin\theta\cos\phi+y_n\sin\theta\sin\phi)}\times\left[\int_{-l_n/2}^{+l_n/2} I_n e^{jkz_n'\cdot\cos\theta}dz_n'\right]\right\}$$

For each conductive line, an electric current is expressed by the following equation.

$$\int_{-l_n/2}^{+l_n/2} I_n e^{jkz_n'\cdot\cos\theta}dz_n' = \sum_{m=1}^{M} l_{nm}\cos\left[\frac{(2m-1)\pi z_n'}{l_n}\right]e^{jkz_n'\cdot\cos\theta}dz_n' \tag{12}$$

$$\int_{-l_n/2}^{+l_n/2} I_n e^{jkz_n'\cdot\cos\theta}dz_n' =$$
$$\sum_{m=1}^{M} l_{nm}\int_0^{+l_n/2} 2\cos\left[\frac{(2m-1)\pi z_n'}{l_n}\right]\times\left[\frac{e^{jkz_n'\cdot\cos\theta}+e^{-jkz_n'\cos\theta}}{2}\right]dz_n' =$$
$$\sum_{m=1}^{M} l_{nm}\int_0^{+l_n/2} 2\cos\left[\frac{(2m-1)\pi z_n'}{l_n}\right]\times\cos(kz_n'\cos\theta)dz_n'$$

If a trigonometric formula is used, Equation (12) above can be expressed by the following equation.

$$2\cos(\alpha)\cos(\beta) = \cos(\alpha+\beta)+\cos(\alpha-\beta) \tag{13}$$

$$\int_{-l_n/2}^{+l_n/2} I_n e^{jkz_n'\cdot\cos\theta}dz_n' =$$
$$\sum_{m=1}^{M} l_{nm}\left\{\int_0^{+l_n/2} 2\cos\left[\frac{(2m-1)\pi}{l_n}+k\cos\theta\right]z_n'dz_n' + \int_0^{+l_n/2} 2\cos\left[\frac{(2m-1)\pi}{l_n}-k\cos\theta\right]z_n'dz_n'\right\}$$

If a trigonometric integration formula is used, Equation (13) above can be expressed by the following equation.

$$\int_0^{\alpha/2} 2\cos[(b\pm c)z]dz = \frac{\alpha}{2}\frac{\sin\left[(b\pm c)\frac{\alpha}{2}\right]}{(b\pm c)\frac{\alpha}{2}} \tag{14}$$

$$\int_{-l_n/2}^{+l_n/2} I_n e^{jkz_n'\cdot\cos\theta}dz_n' = \sum_{m=1}^{M} l_{nm}\left[\frac{\sin(z^+)}{z^+}+\frac{\sin(z^-)}{z^-}\right]\frac{l_n}{2}$$

$$z^+ = \left[\frac{(2m-1)\pi}{l_n}+k\cos\theta\right]\frac{l_n}{2}$$

$$z^- = \left[\frac{(2m-1)\pi}{l_n}-k\cos\theta\right]\frac{l_n}{2}$$

By using Equation (14) above, a whole electric field can be expressed by the following equation.

$$E_\theta = \sum_{n=1}^{N} E_{\theta n} = -j\omega A \tag{15}$$

$$A_\theta = \sum_{n=1}^{N} A_{\theta n} = -\frac{\mu e^{-jkr}}{4\pi r}\sin\theta\sum_{n=1}^{N}\left\{e^{jk(x_n\sin\theta\cos\phi+y_n\sin\theta\sin\phi)}\cdot\sum_{m=1}^{M} l_{nm}\left[\frac{\sin(z^+)}{z^+}+\frac{\sin(z^-)}{z^-}\right]\right\}\frac{l_n}{2}$$

Figure 8:
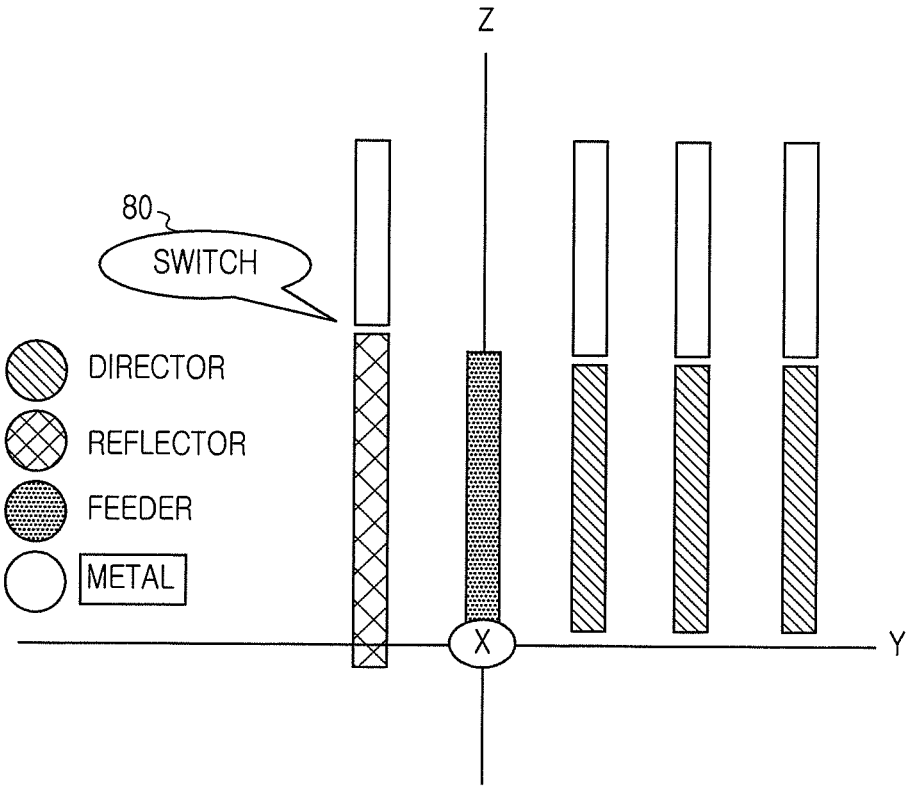
FIG. 8 illustrates a diagram of a beam-forming system that includes a switch according to an example embodiment of the present disclosure.

FIG. 8 illustrates a diagram of a beam-forming system that includes a switch according to an example embodiment of the present disclosure.

Referring to FIG. 8, a Yagi-Uda antenna that includes a switch 80 illustrated in a Z-Y plane. The Yagi-Uda antenna includes a reflector, a feeder, three directors, and a switch.

The beam-forming system according to the example embodiment of the present disclosure includes a structure of FIG. 8, that is, a structure in which one feeder is shared by being arranged in 360 degrees as illustrated in FIG. 5 and a director and a reflector exist in several directions.

In the Yagi-Uda antenna with the structure of FIG. 8, the feeder is supplied with energy directly through a feeding transmission line, and the remaining elements, i.e., the reflector and the director, are mutually combined with each other and operate as parasitic elements in which an electronic current is generated.

Referring to FIG. 5, directors and reflectors exist in several directions. In order to remove an influence of directors and reflectors arranged in other directions, other than directors and reflectors arranged in a desired direction for radiating a beam in FIG. 8, a length of directors and reflectors, other than directors and reflectors operating at a desired frequency, is changed by using a switch. By regulating the length in this manner, the directors and reflectors are changed to directors and reflectors operating at other frequencies.

However, even though they are changed to the directors and reflectors operating at other frequencies by regulating the length, a re-radiation is generated when an electronic current is induced to the directors and reflectors, and thus they are changed to the directors and reflectors operating at other frequencies. This has an effect on the directors and reflectors operating at a desired operating frequency. Therefore, in case of changing the length simply by using the switch, in one embodiment, it may be difficult to completely remove the influence of the directors and reflectors arranged in directions other than the desired direction. In order to completely remove such an influence, a floating metal is used as illustrated in FIG. 9.

Figure 9:
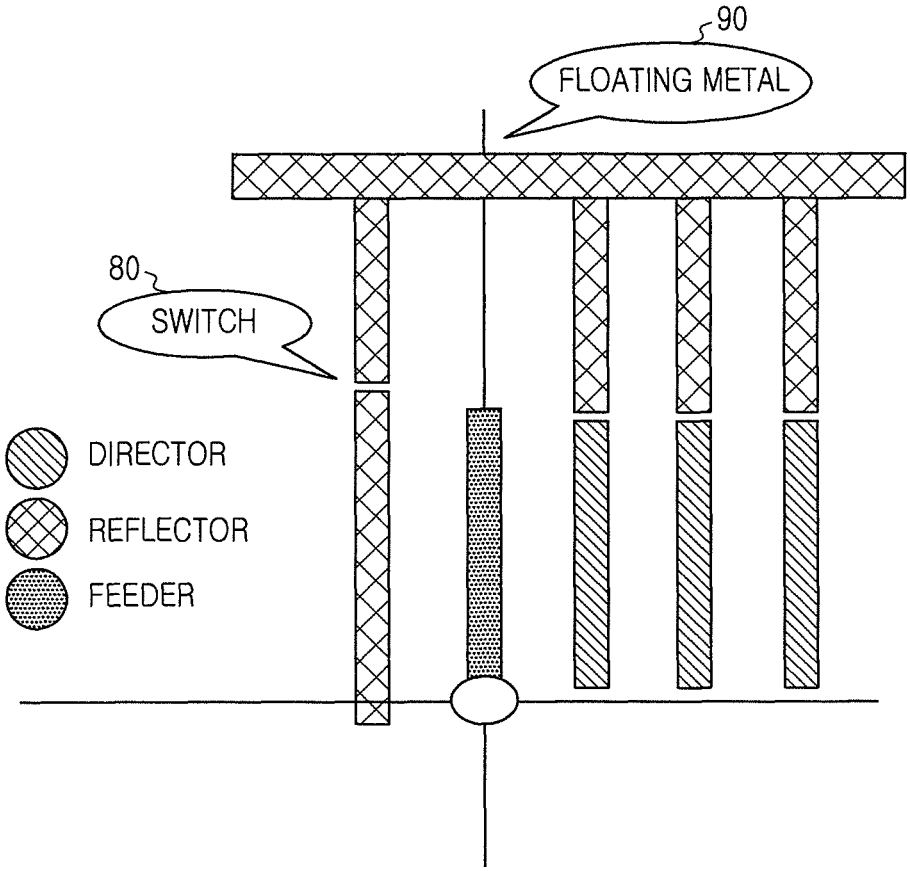
FIG. 9 illustrates a first diagram of a beam-forming system that includes a switch and a floating metal according to an example embodiment of the present disclosure.

FIG. 9 illustrates a first diagram of a beam-forming system that includes a switch 80 and a floating metal 90 according to an example embodiment of the present disclosure.

Referring to FIG. 9, a structure is illustrated in which floating metal 90 is added to the Yagi-Uda antenna of FIG. 8 in such a manner that directors and reflectors, other than directors and reflectors operating at a desired frequency, are changed to directors and reflectors operating at other frequencies by changing a length by the use of switch 80.

In this structure, in order to avoid a situation in which an electric current is induced to the changed directors and the reflectors and thus a re-radiation process is performed, which has an effect on the directors and reflectors operating at a desired operating frequency, floating metal 90 is brought in contact with directors and reflectors, other than the directors and reflectors operating at the desired operating frequency.

An electric current is induced by a feeder to parasitic elements (i.e., the directors and the reflectors), and this electric current is re-radiated by the parasitic elements. However, by connecting the parasitic elements to floating metal 90, the induced electric current flows by being evenly distributed to the wide floating metal 90. Therefore, a size of the electric current is significantly decreased and thus the re-radiation process caused by the parasitic elements connected to floating metal 90 is not performed, which results in having no effect on beam-forming. That is, by connecting floating metal 90 to the reflectors and directors arranged in directions other than the desired direction, a role of preventing them from operating as normal reflectors and directors is performed.

The reflector and the director include a connection point to connect to floating metal 90. A controller of the present disclosure connects the reflectors and directors, other than the reflectors and directors arranged in the desired direction among the reflectors and directors arranged in several directions, to floating metal 90 by using switch 80, and thus can generate and regulate a beam by operating only the reflectors and directions arranged in the desired direction. Accordingly, the present disclosure can regulate a desired gain and a Half Power Beam Width (HPBW).

Figure 10B:
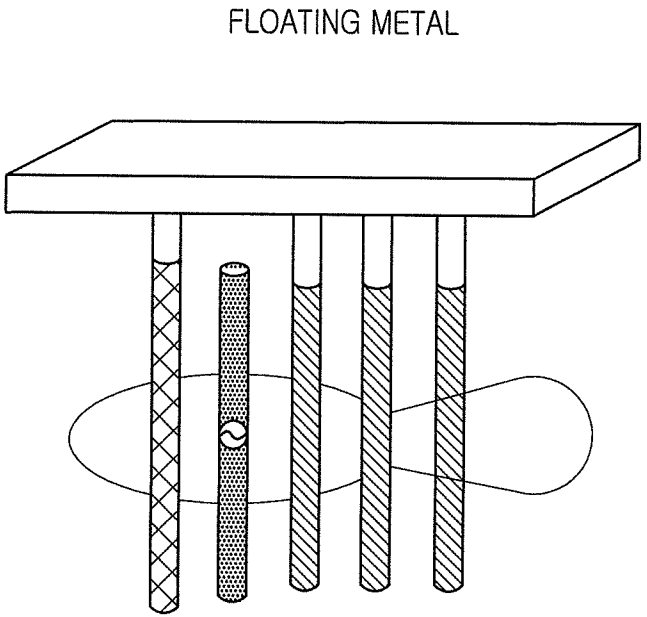
FIG. 10A and FIG. 10B illustrate a second diagram of a beam-forming system that includes a switch and a floating metal according to an example embodiment of the present disclosure.
Figure 10A:
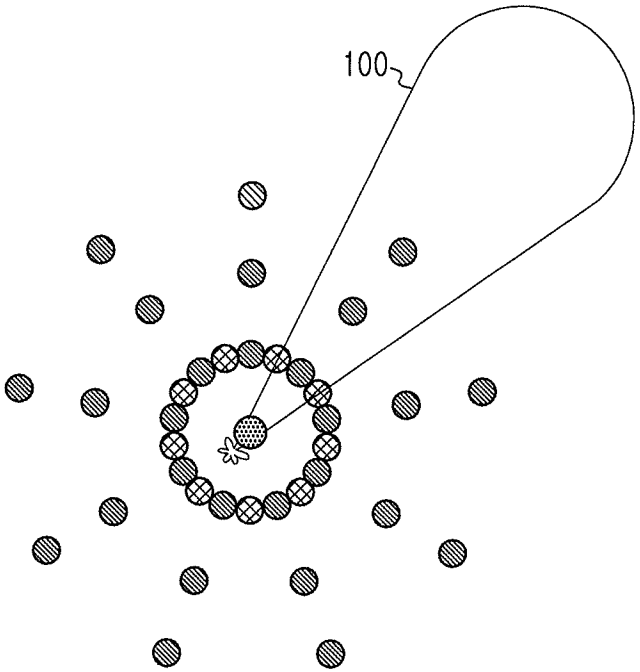

FIG. 10A and FIG. 10B illustrate a second diagram of a beam-forming system that includes a switch and a floating metal according to an example embodiment of the present disclosure.

Referring to FIGS. 10A and 10B, if a floating metal is in contact with directors and reflectors, other than those arranged in a direction in which a beam 100 is radiated, beam 100 is not radiated in a direction of the contacted reflectors and directors.

Figure 11:
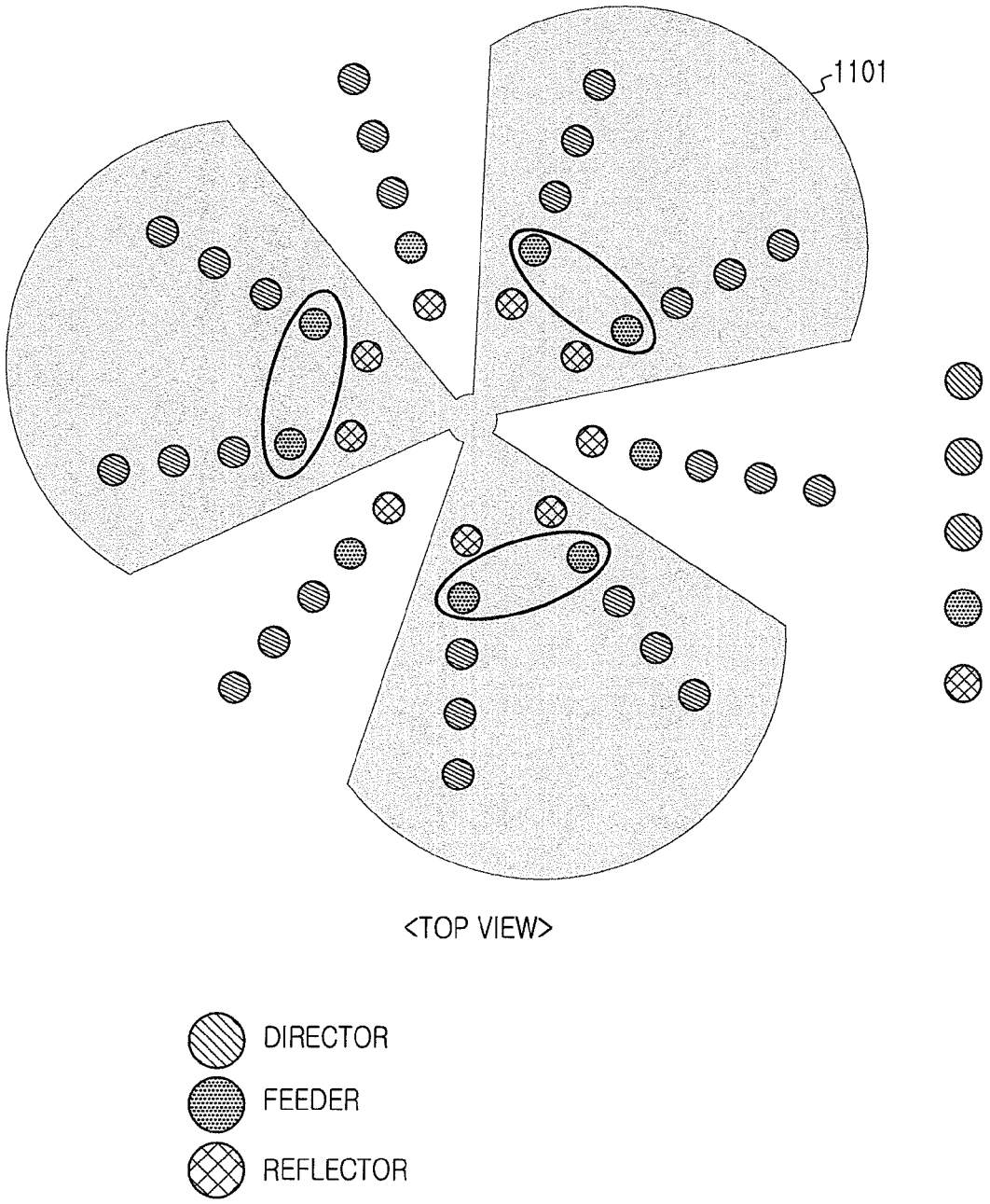
FIG. 11 illustrates a first diagram of a beam-forming system when there are a plurality of feeders according to an example embodiment of the present disclosure.

FIG. 11 illustrates a first diagram of a beam-forming system when there is a plurality of feeders according to an example embodiment of the present disclosure.

Referring to FIG. 11, there is a plurality of feeders, and an operation principle is the same according to a beam-forming system in which a feeder is shared according to the example embodiment of the present disclosure. It is illustrated in FIG. 11 that, if a floating metal 1101 is in contact with directors and reflectors, other than those arranged in a direction in which a beam is radiated, the beam is not radiated in a direction of the contacted reflectors and directors, but is radiated in a direction of non-contacted reflectors and directors.

Figure 12:
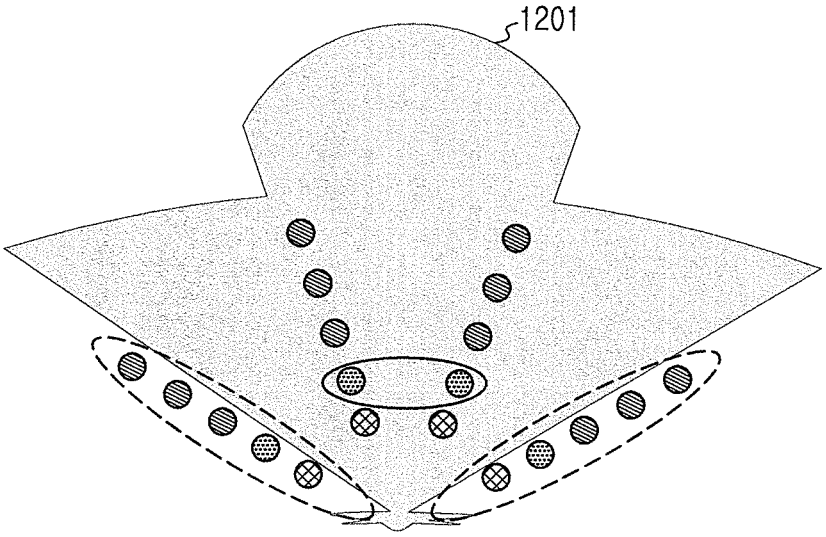
FIG. 12 illustrates a second diagram of a beam-forming system when there are a plurality of feeders according to an example embodiment of the present disclosure.

FIG. 12 illustrates a second diagram of a beam-forming system when there is a plurality of feeders according to an example embodiment of the present disclosure.

Referring to FIG. 12, there is a plurality of feeders, and an operation principle is the same according to a beam-forming system in which a feeder is shared according to the example embodiment of the present disclosure. It is illustrated in FIG. 12 that, if a floating metal 1201 is in contact with directors and reflectors, other than those arranged in a direction in which a beam is radiated, the beam is not radiated in a contacted reflector and director direction, and the beam is radiated in a non-contacted reflector and director direction.

Figure 13:
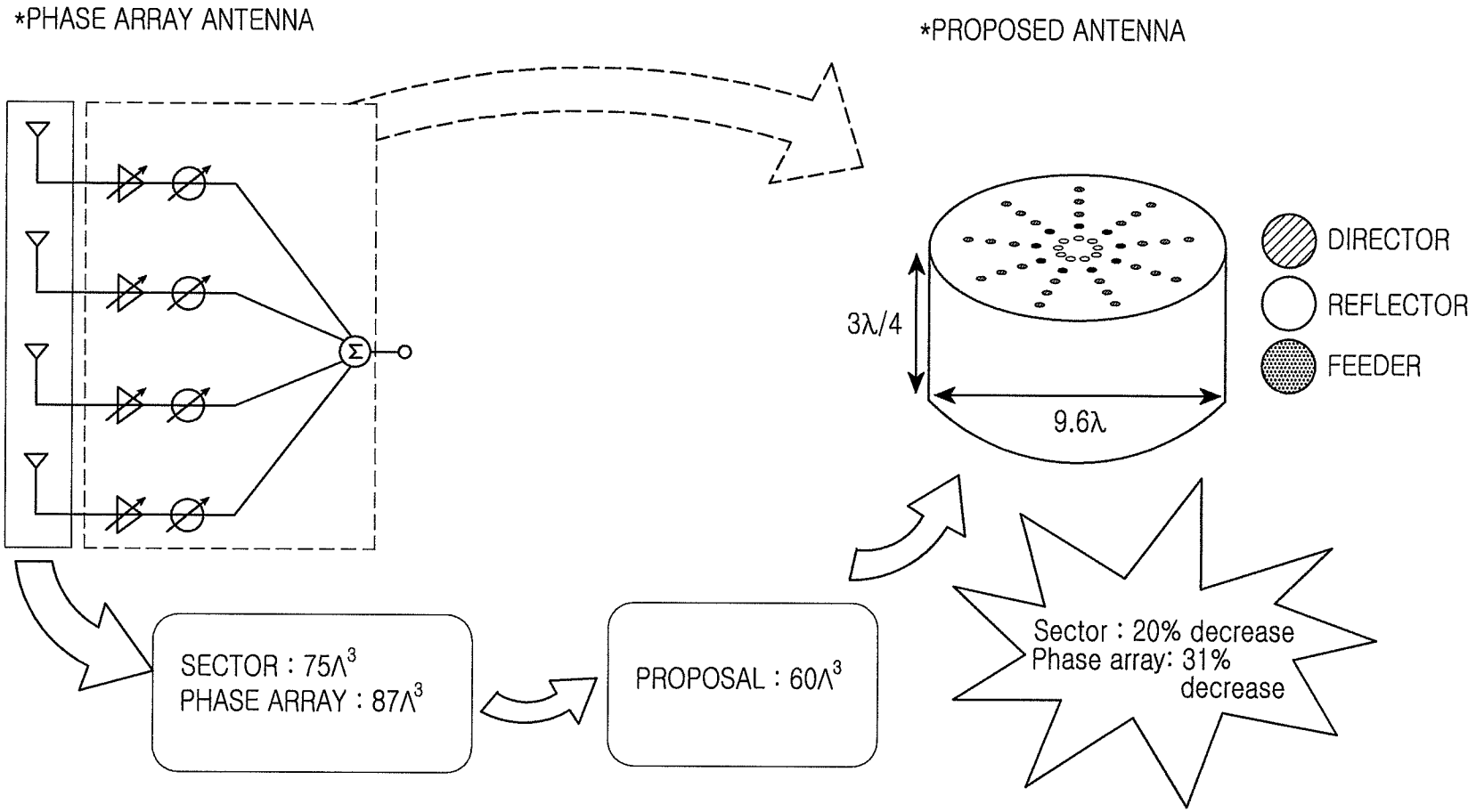
FIG. 13 illustrates a diagram of a performance difference between a legacy system and a beam-forming system according to an example embodiment of the present disclosure.

FIG. 13 illustrates a diagram of a performance difference between a legacy system and a beam-forming system according to an example embodiment of the present disclosure.

Referring to FIG. 13, in comparison with the legacy system, the beam-forming system of the present disclosure includes an advantage in that a sector volume is decreased by 20%, and a phase array antenna volume is decreased by 31%.

Figure 14:
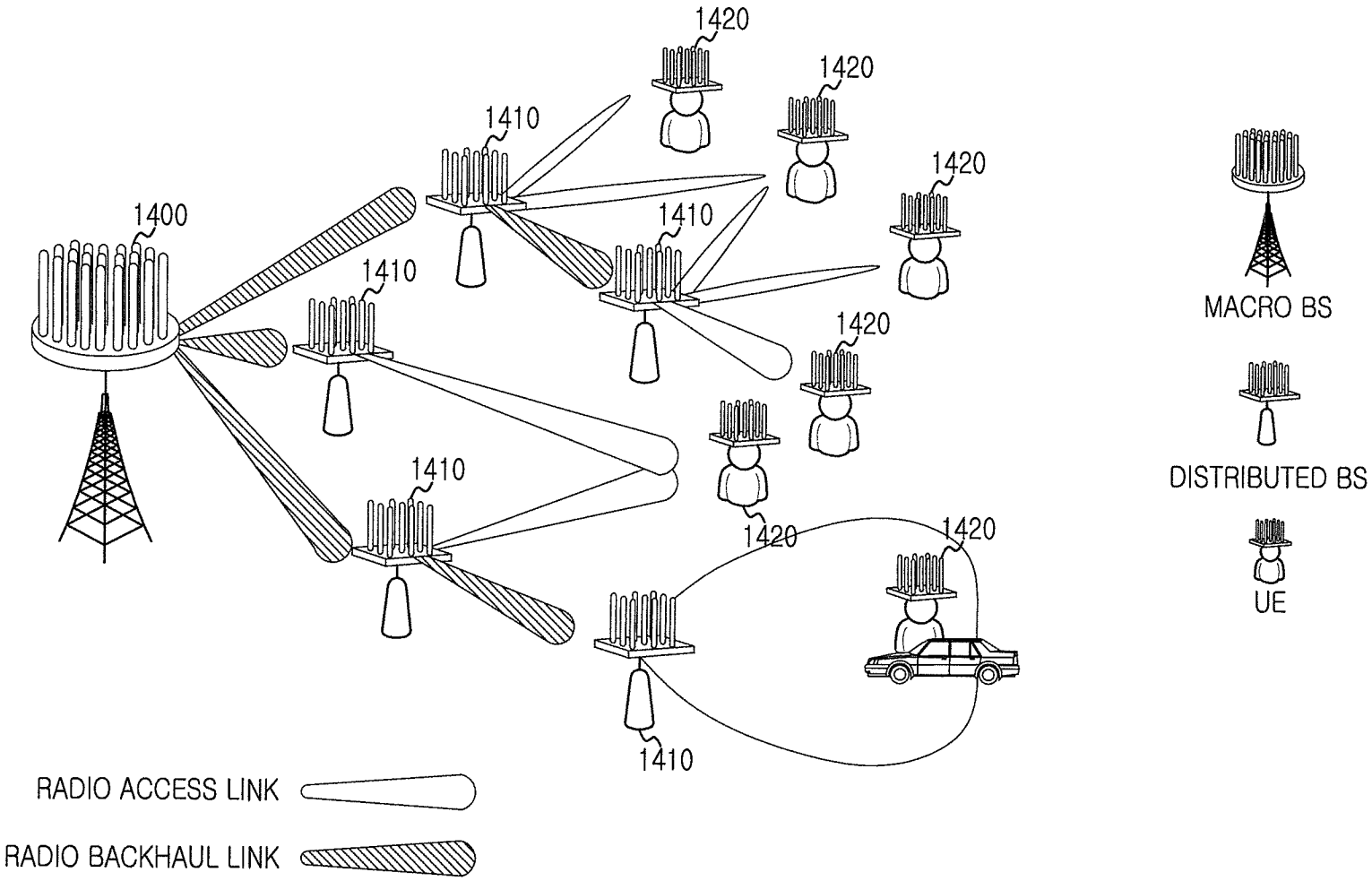
FIG. 14 illustrates a diagram of a Beam Division Multiple Access (BDMA) system according to an example embodiment of the present disclosure.

FIG. 14 illustrates a diagram of a Beam Division Multiple Access (BDMA) system according to an example embodiment of the present disclosure.

Referring to FIG. 14, the BDMA system is described as an example of a communication system applicable to a beam-forming system of the present disclosure.

The BDMA system includes a macro Base Station (BS) 1400, a plurality of distributed BSs 1410, and a plurality of User Equipments (UEs) 1420. The macro BS 1400 and the plurality of distributed BSs 1410 use a multi-band wireless communication technique. The macro BS 1400 and the plurality of distributed BSs 1410 may selectively utilize a frequency band according to a channel situation and usage. For example, a large-capacity, high-frequency band may be used in a Line of Sight (LOS) situation, and a low-frequency band may be used in a None Line of Sight (NLOS) situation.

Herein, the macro BS 1400 and the plurality of distributed BSs 1410 use an array antenna at each frequency band to include a spatial selectivity. For example, the array antenna may be the beam-forming system of the present disclosure.

Figure 15:
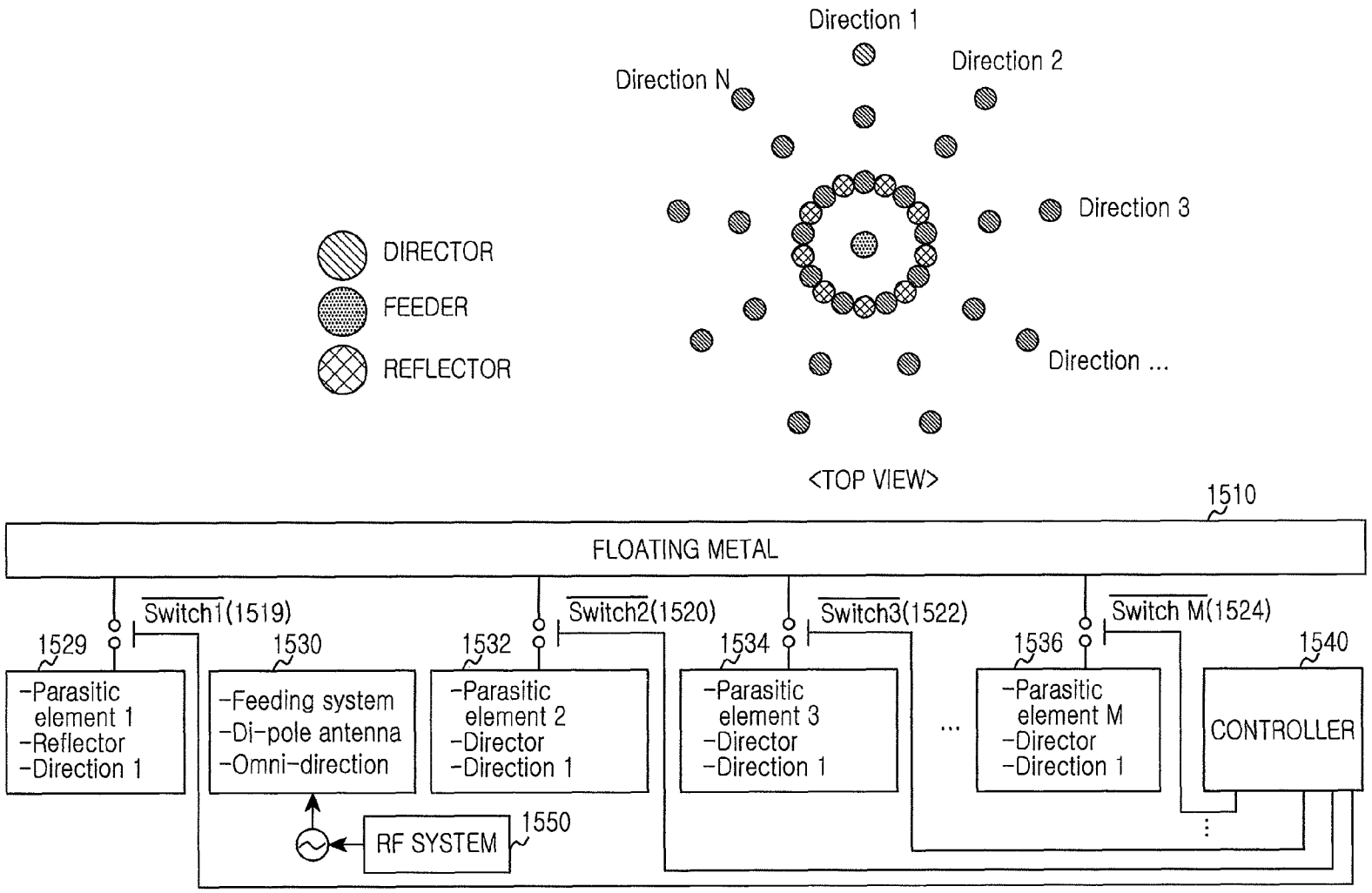
FIG. 15 illustrates a first block diagram of a structure of a beam-forming system according to an example embodiment of the present disclosure.

FIG. 15 illustrates a first block diagram of a structure of a beam-forming system according to an example embodiment of the present disclosure.

Referring to FIG. 15, the beam-forming system includes a floating metal 1510, a plurality of switches 1519, 1520, 1522, and 1524, a controller 1540, a plurality of parasitic elements 1529, 1532, 1534, and 1536, a feeding system 1530, and a Radio Frequency (RF) system 1550. The controller 1540 may include a memory and a processor that may execute a set of instructions stored in the memory.

As illustrated in an upper portion of FIG. 15, the parasitic elements 1529, 1532, 1534, and 1536 and the feeding system 1530 exist in plural number in the beam-forming system.

The feeding system 1530 is connected to the RF system 1550. A signal provided from the RF system 1550 is provided to the feeding system 1530, and thereafter a beam is radiated.

When a width and direction of the beam to be radiated is determined by the controller 1540, the controller 1540 allows the floating metal 1510 to be in contact with the parasitic elements 1529, 1532, 1534, and 1536 not corresponding to the width and direction of the beam to be radiated, by using at least one of the switches 1519, 1520, 1522, and 1524.

Thereafter, the beam is not radiated in a direction of the contacted parasitic elements 1529, 1532, 1534, and 1536, but is radiated in a direction of non-contacted parasitic elements.

Figure 16:
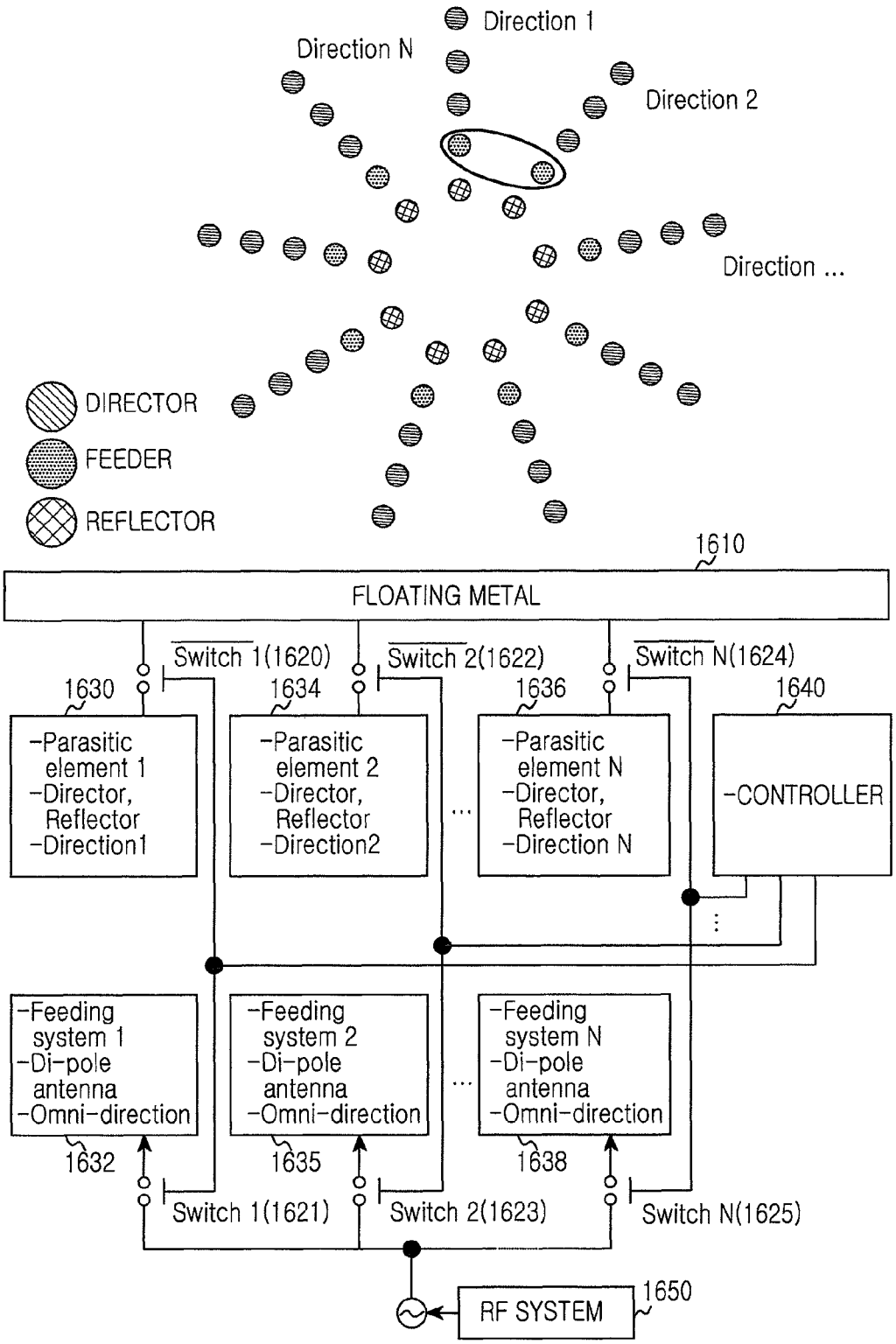
FIG. 16 illustrates a second block diagram of a structure of a beam-forming system according to an example embodiment of the present disclosure.

FIG. 16 illustrates a second block diagram of a structure of a beam-forming system according to an example embodiment of the present disclosure.

Referring to FIG. 16, the beam-forming system includes a floating metal 1610, a plurality of switches 1620, 1621, 1622, 1623, 1624, and 1625, a controller 1640, a plurality of parasitic elements 1630, 1634, 1635, 1636, and 1638, a plurality of feeding systems 1632, 1635, and 1638, and an RF system 1650.

As illustrated in an upper portion of FIG. 16, the parasitic elements 1629, 1632, 1634, and 1636 and the feeding system 1632, 1635, and 1638 exist in plural number in the beam-forming system.

The plurality of feeding systems 1632, 1635, and 1638 are connected to the RF system 1650. A signal provided from the RF system 1650 is provided to the feeding systems 1632, 1635, and 1638, and thereafter a beam is radiated.

When a width and direction of the beam to be radiated is determined by the controller 1640, the controller 1640 allows the floating metal 1610 to be in contact with the parasitic elements not corresponding to the width and direction of the beam to be radiated, by using at least one of the switches 1620, 1621, 1622, 1623, 1624, and 1625.

Thereafter, the beam is not radiated in a direction of the contacted parasitic elements, but is radiated in a direction of the non-contacted parasitic elements.

Figure 17:
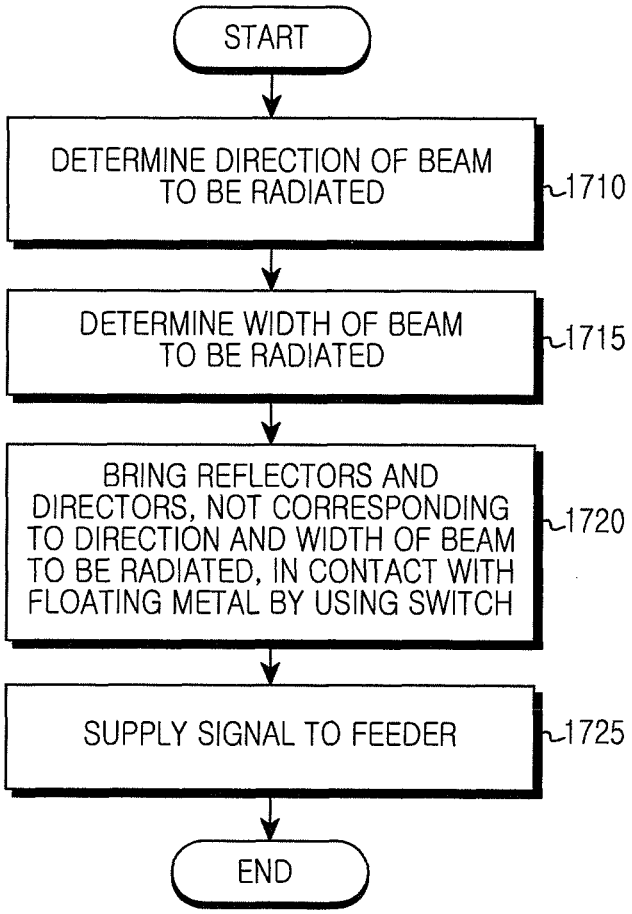
FIG. 17 illustrates a process of operating a beam-forming system according to an example embodiment of the present disclosure.

FIG. 17 illustrates a process of operating a beam-forming system according to an example embodiment of the present disclosure.

Referring to FIG. 17, a controller of the system determines a direction of a beam to be radiated (block 1710), and determines a width of the beam to be radiated (block 1715).

Thereafter, the controller uses a switch to bring reflectors and directors, not corresponding to the direction and width of the beam to be radiated, in contact with a floating metal (block 1720).

Thereafter, the controller supplies a signal to a feeder such that the beam is radiated according to a desired direction and width of the beam.

Figure 18:
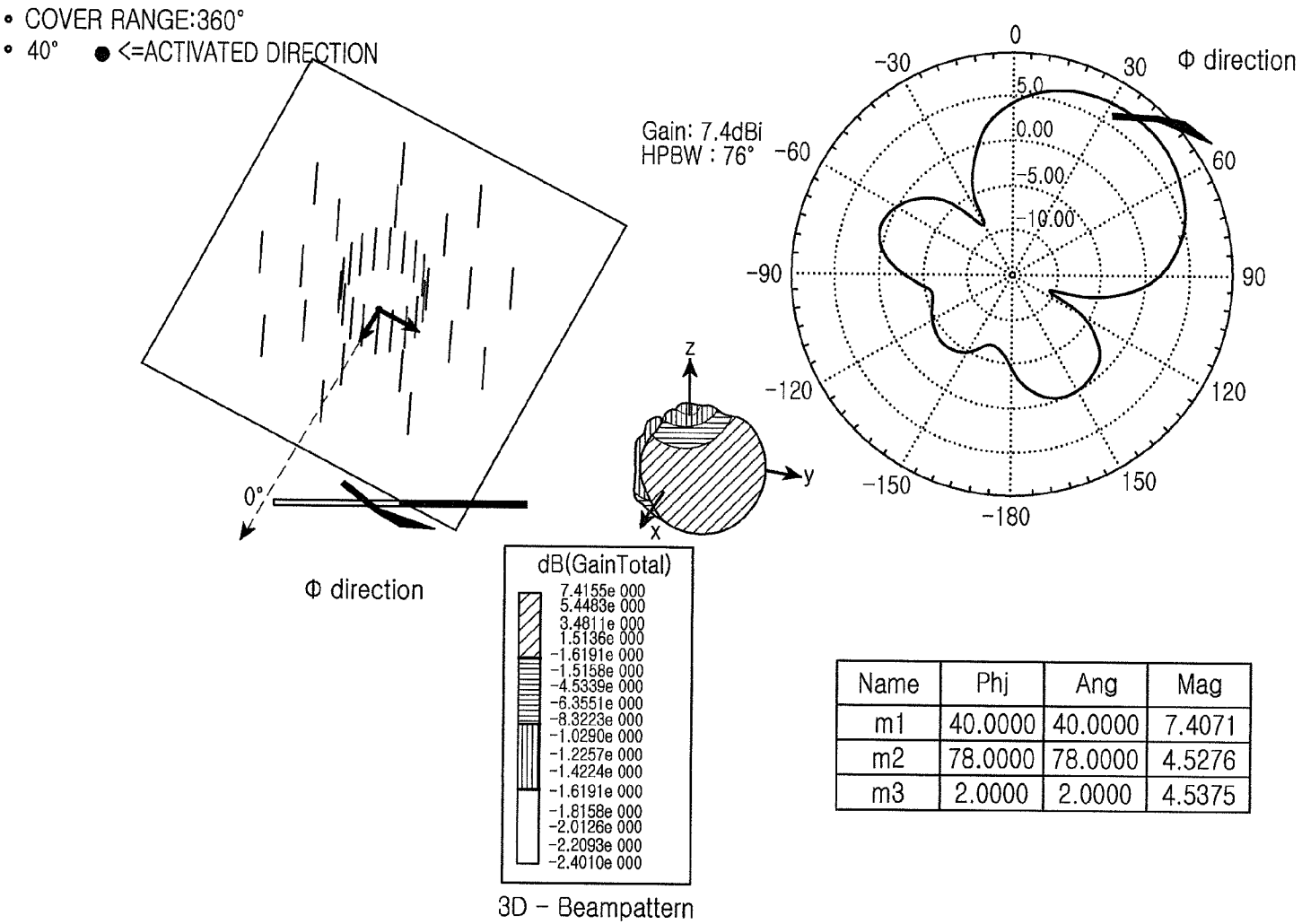
FIG. 18 illustrates a first diagram of a simulation result according to an example embodiment of the present disclosure.

FIG. 18 illustrates a first diagram of a simulation result according to an example embodiment of the present disclosure.

Referring to FIG. 18, it is shown an example of generating a beam in one direction in such a manner that directors and reflectors are arranged about one feeder. An activated direction is 40 degrees.

Figure 19:
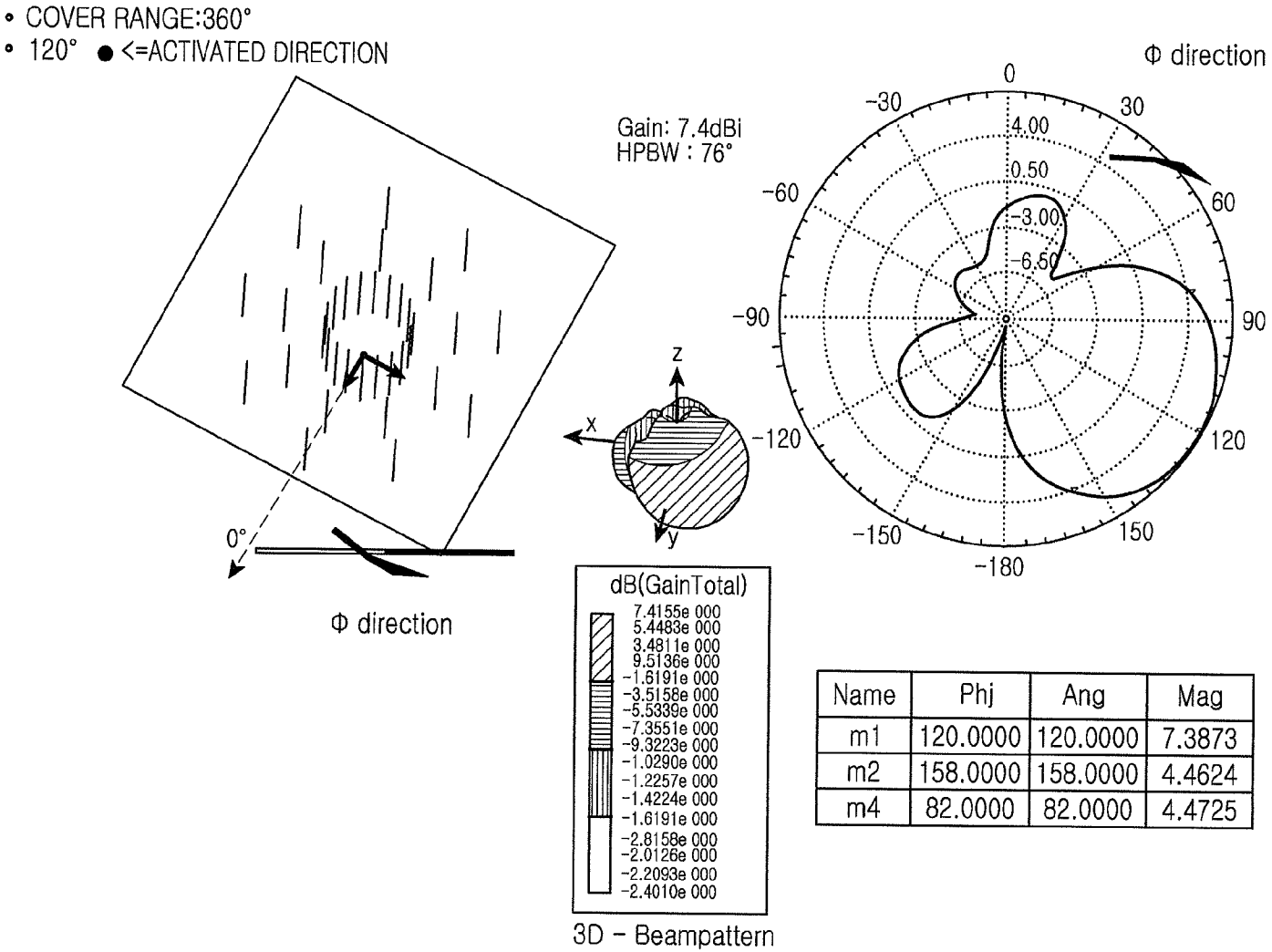
FIG. 19 illustrates a second diagram of a simulation result according to an example embodiment of the present disclosure.

FIG. 19 illustrates a second diagram of a simulation result according to an example embodiment of the present disclosure.

Referring to FIG. 19, it is shown an example of generating a beam in one direction in such a manner that directors and reflectors are arranged about one feeder. An activated direction is 120 degrees.

Figure 20:
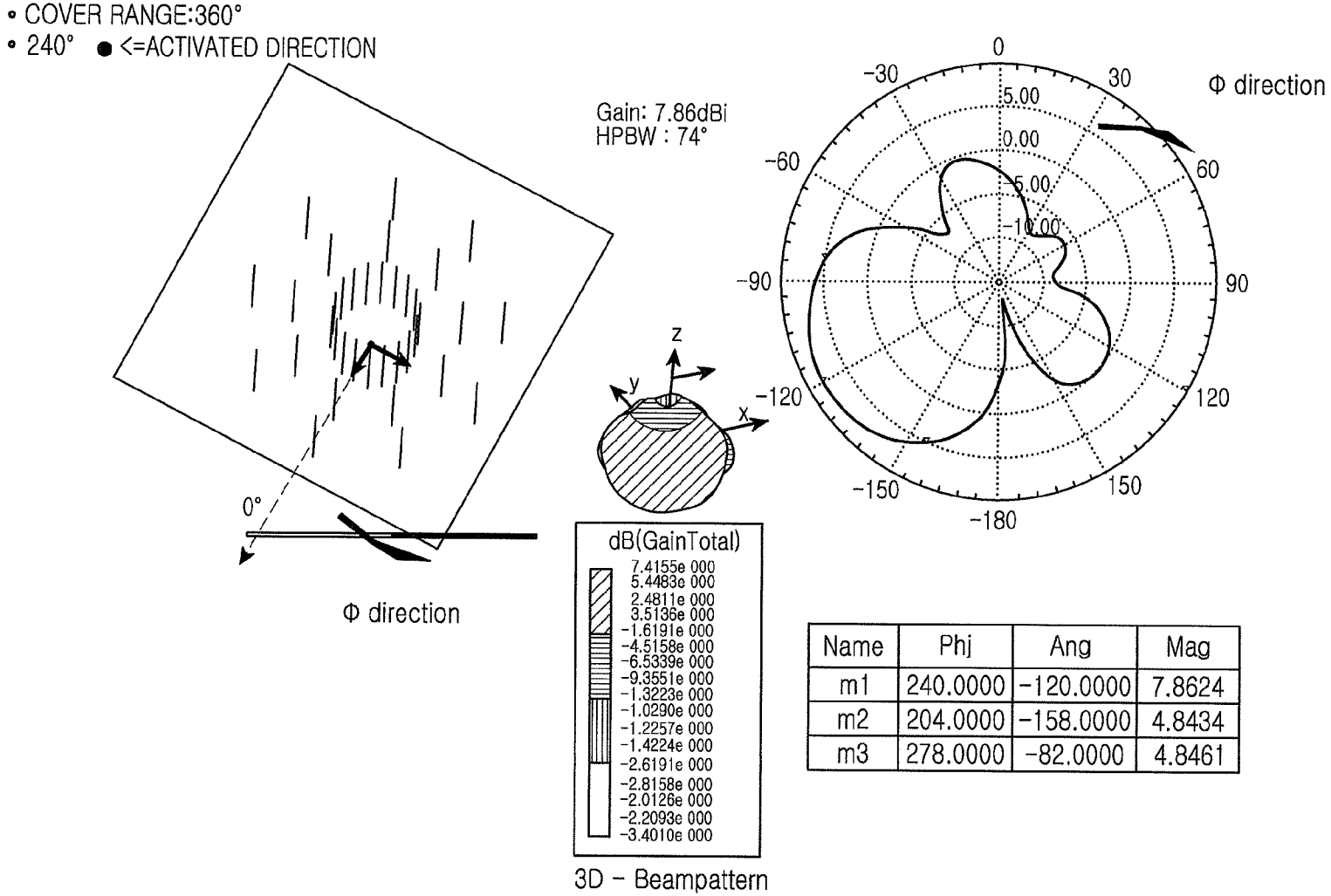
FIG. 20 illustrates a third diagram of a simulation result according to an example embodiment of the present disclosure.

FIG. 20 illustrates a third diagram of a simulation result according to an example embodiment of the present disclosure.

Referring to FIG. 20, it is shown an example of generating a beam in one direction in such a manner that directors and reflectors are arranged about one feeder. An activated direction is 240 degrees.

Figure 21:
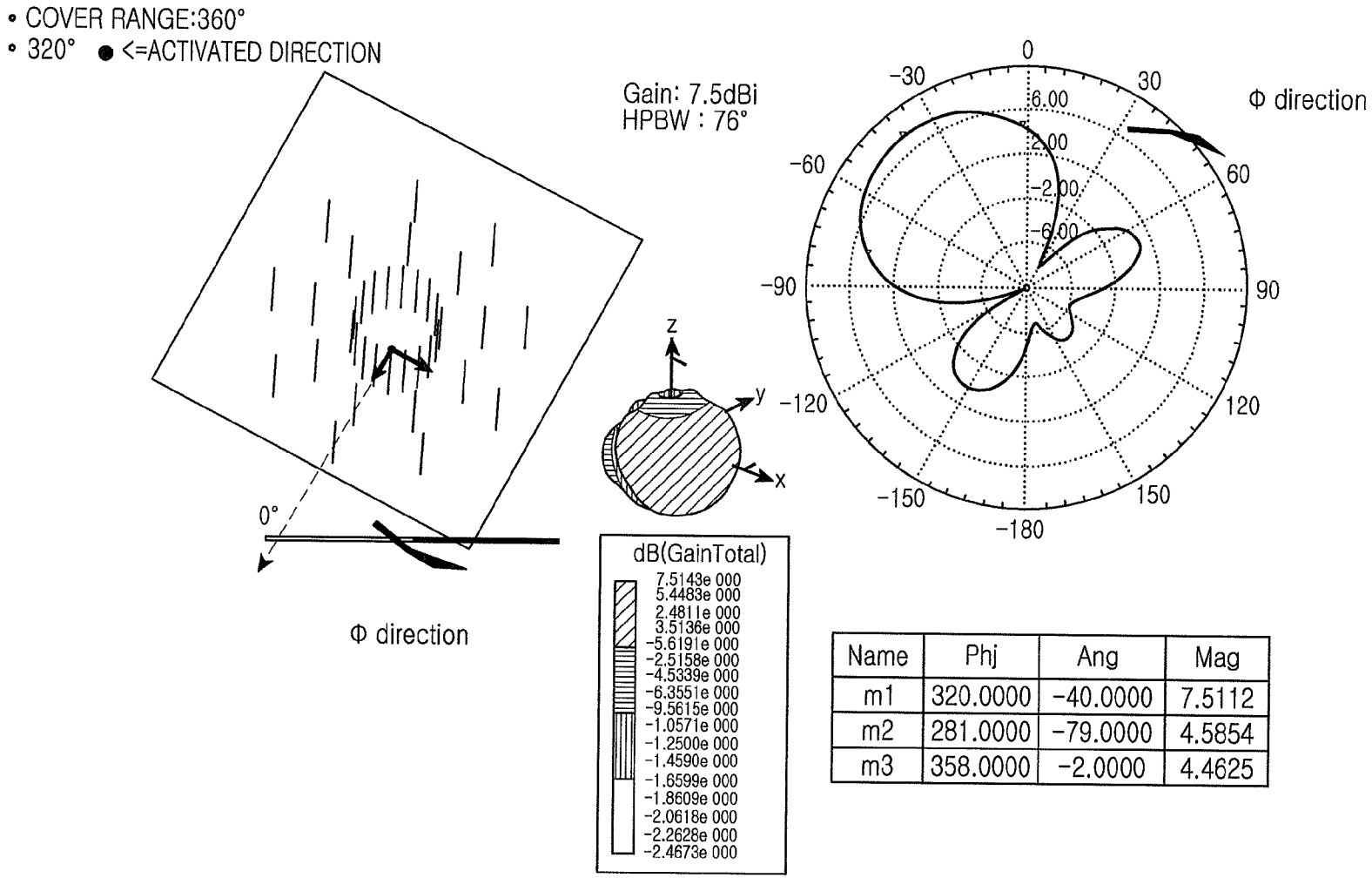
FIG. 21 illustrates a fourth diagram of a simulation result according to an example embodiment of the present disclosure.

FIG. 21 illustrates a fourth diagram of a simulation result according to an example embodiment of the present disclosure.

Referring to FIG. 21, it is shown an example of generating a beam in one direction in such a manner that directors and reflectors are arranged about one feeder. An activated direction is 320 degrees.

Figure 22:
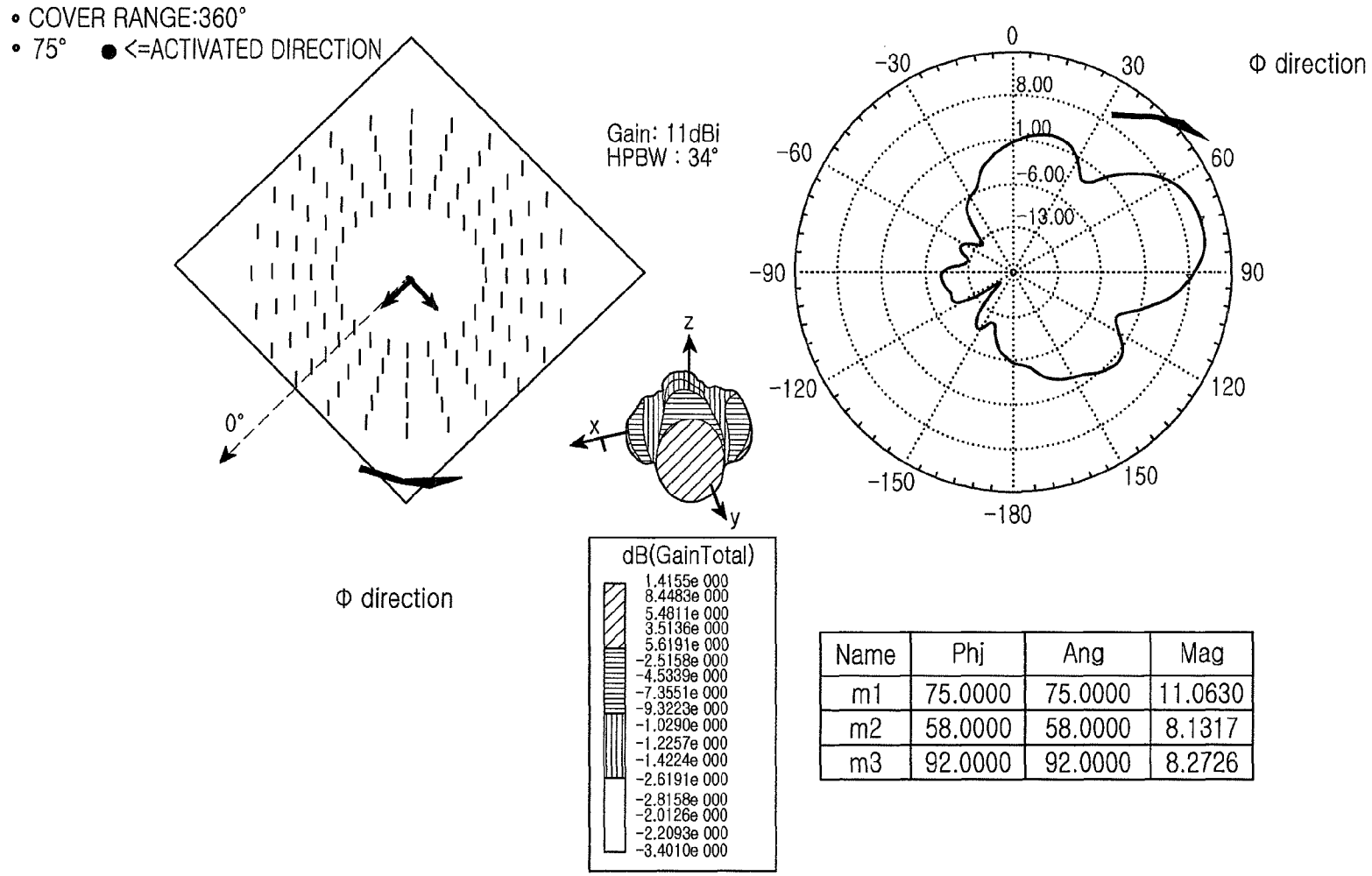
FIG. 22 illustrates a fifth diagram of a simulation result according to an example embodiment of the present disclosure.

FIG. 22 illustrates a fifth diagram of a simulation result according to an example embodiment of the present disclosure.

Referring to FIG. 22, it is shown an example of decreasing a gain and a HPBW by using two feeders. An activated direction is 75 degrees.

Figure 23:
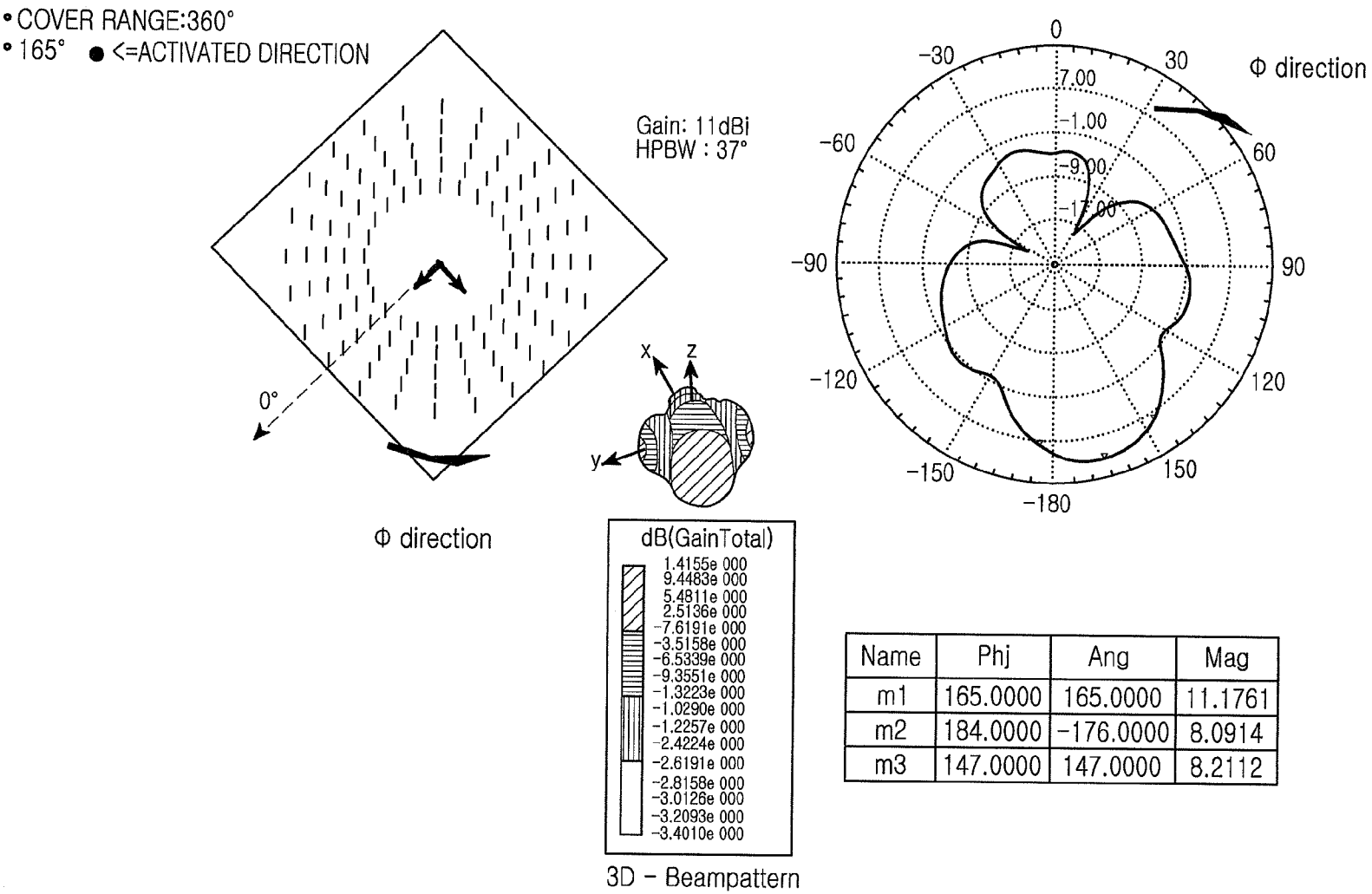
FIG. 23 illustrates a sixth diagram of a simulation result according to an example embodiment of the present disclosure.

FIG. 23 illustrates a sixth diagram of a simulation result according to an example embodiment of the present disclosure.

Referring to FIG. 23, it is shown an example of decreasing a gain and a HPBW by using two feeders. An activated direction is 165 degrees.

Figure 24:
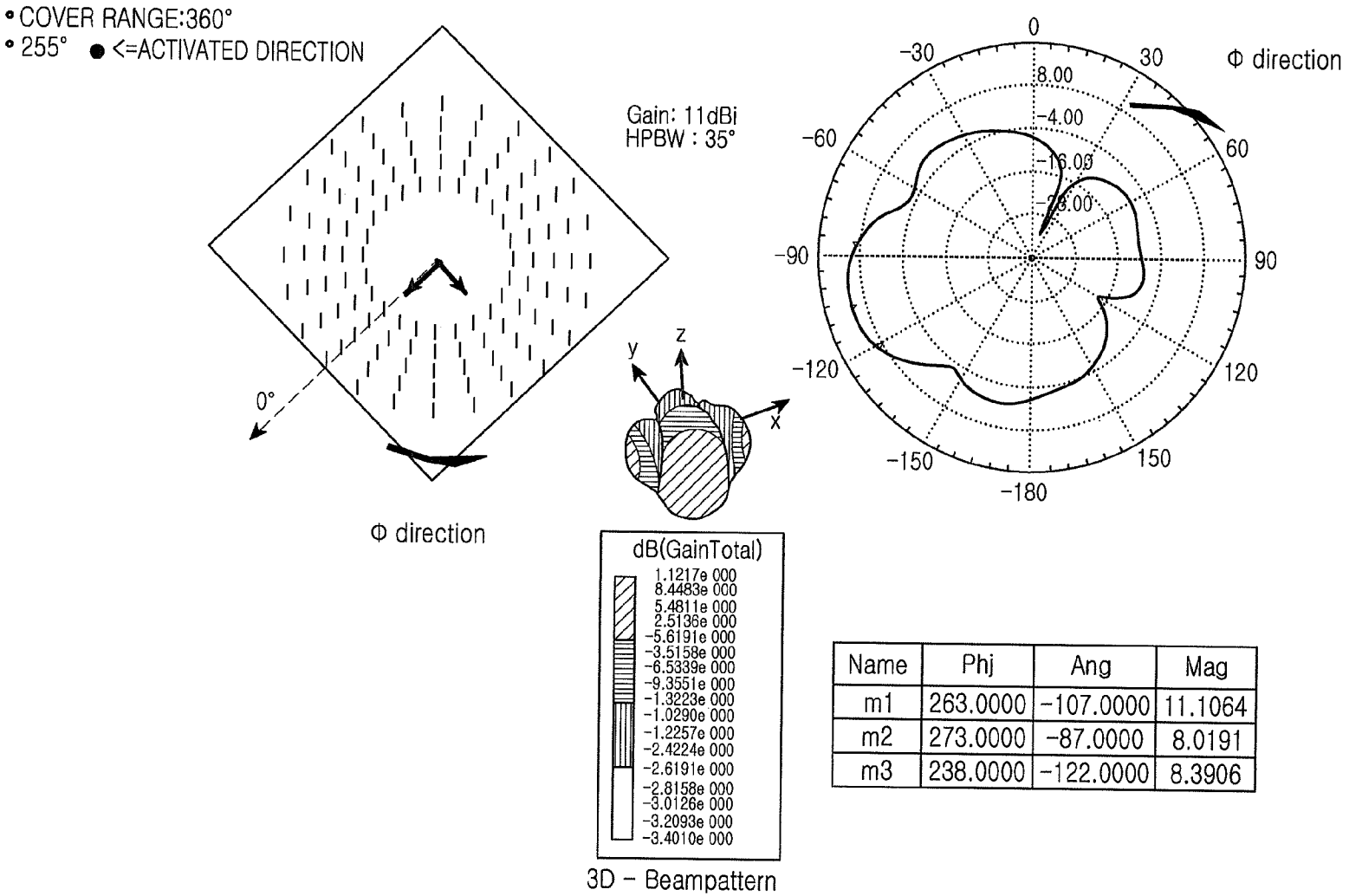
FIG. 24 illustrates a seventh diagram of a simulation result according to an example embodiment of the present disclosure.

FIG. 24 illustrates a seventh diagram of a simulation result according to an example embodiment of the present disclosure.

Referring to FIG. 24, it is shown an example of decreasing a gain and a HPBW by using two feeders. An activated direction is 255 degrees.

Figure 25:
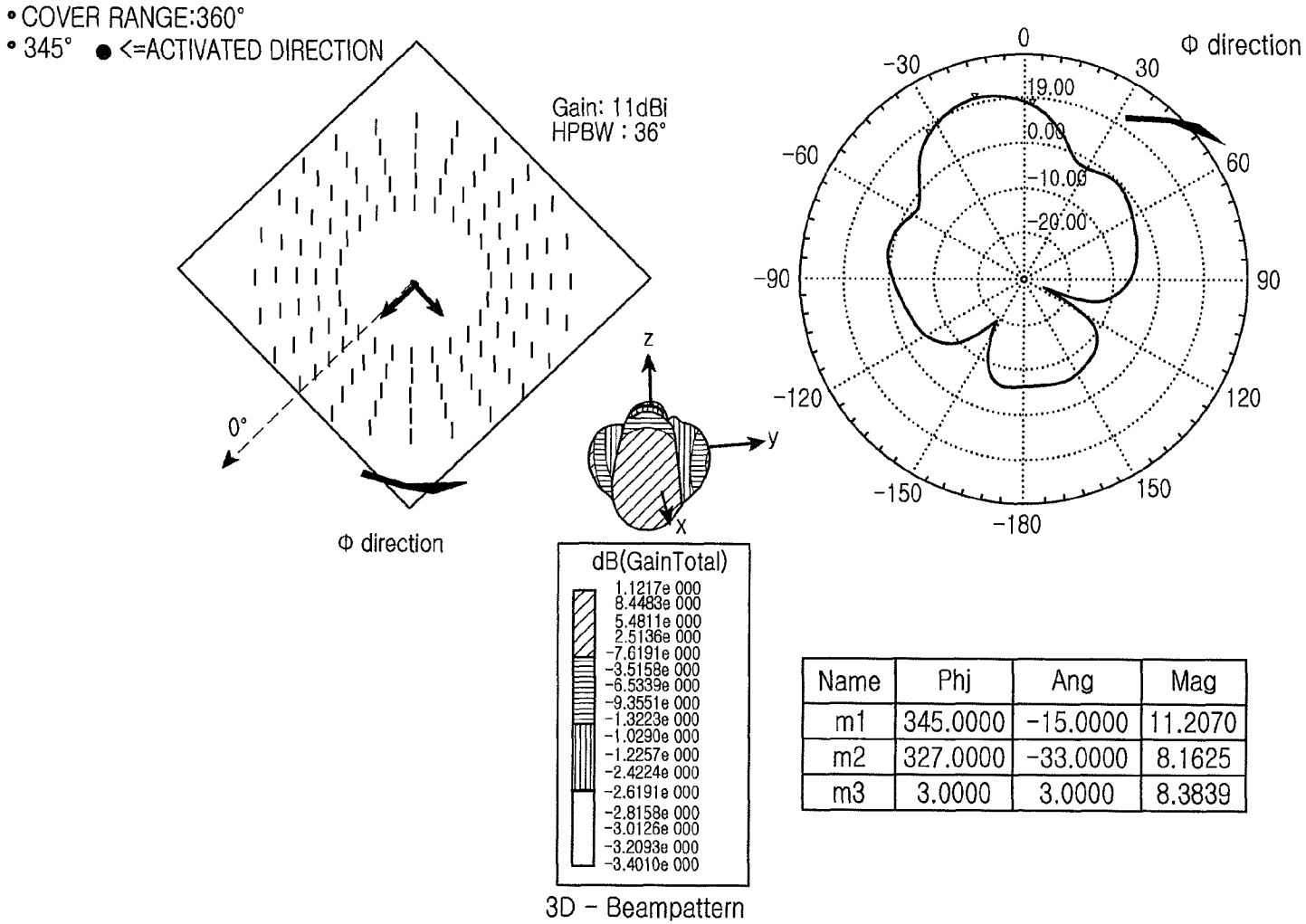
FIG. 25 illustrates an eighth diagram of a simulation result according to an example embodiment of the present disclosure.

FIG. 25 illustrates an eighth diagram of a simulation result according to an example embodiment of the present disclosure.

Referring to FIG. 25, it is shown an example of decreasing a gain and a HPBW by using two feeders. An activated direction is 345 degrees.

Figure 26:
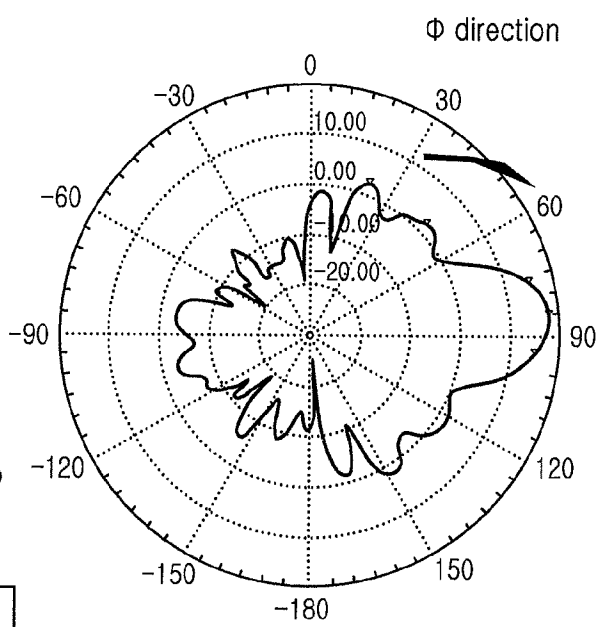
FIG. 26 illustrates a ninth diagram of a simulation result according to an example embodiment of the present disclosure.
Figure 26:
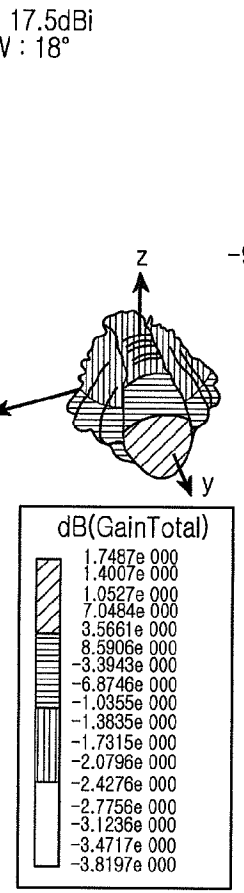
Figure 26:
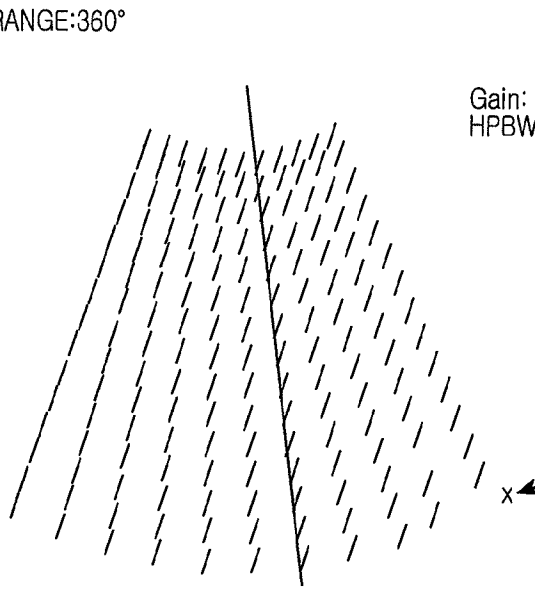

FIG. 26 illustrates a ninth diagram of a simulation result according to an example embodiment of the present disclosure.

Referring to FIG. 26, an activated direction is 345 degrees, a HPBW is decreased to 18 degrees, and a gain is 17.5 dBi.

Figure 27:
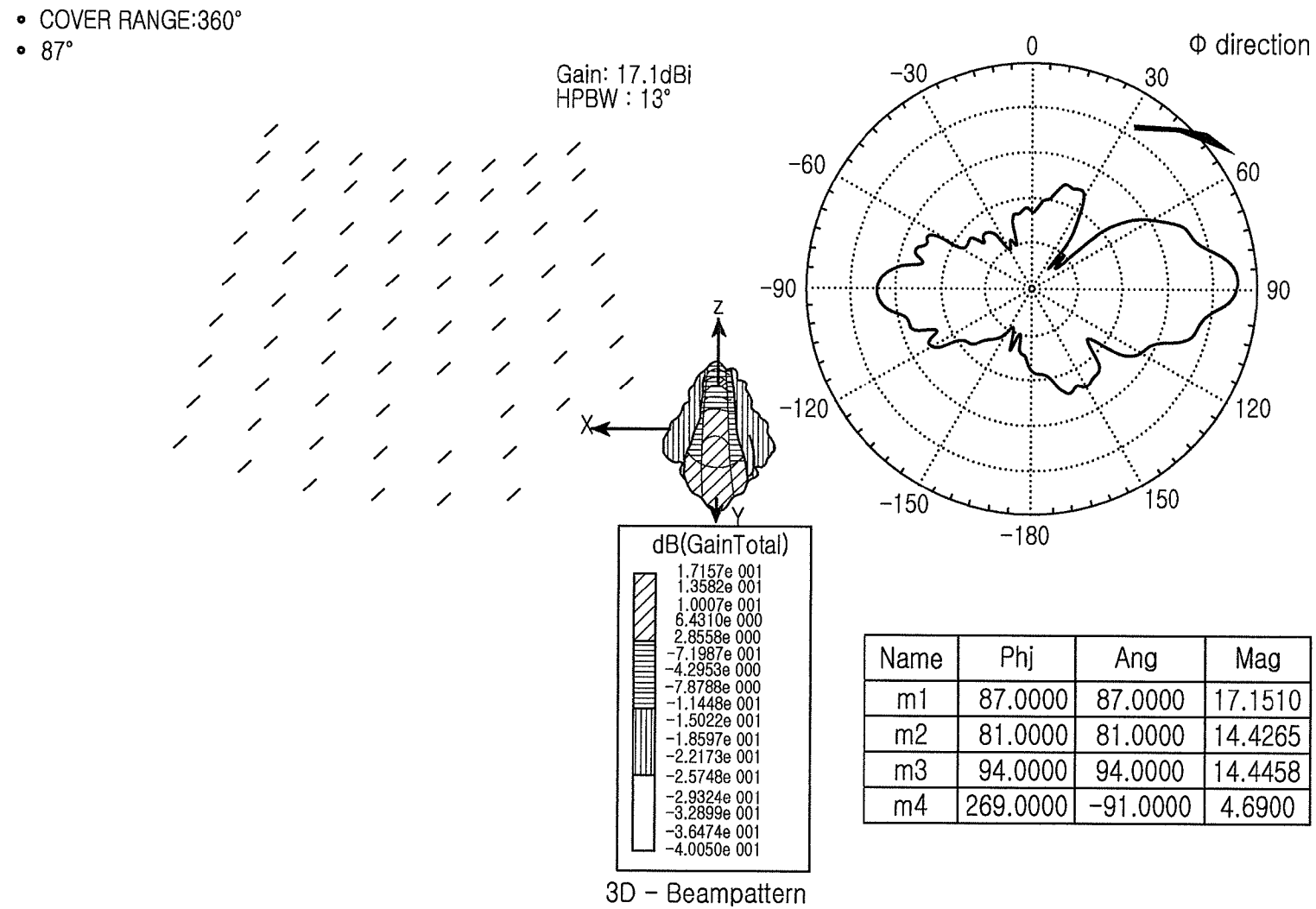
FIG. 27 illustrates a tenth diagram of a simulation result according to an example embodiment of the present disclosure.

FIG. 27 illustrates a tenth diagram of a simulation result according to an example embodiment of the present disclosure.

Referring to FIG. 27, an activated direction is 85 degrees, a HPBW is decreased to 13 degrees, and a gain is 17.1 dBi.

In terms of system simplification, the present disclosure includes an advantage in that basic elements and additional elements which increase a system complexity are significantly simplified, and thus a beam-forming system can be implemented with a low cost, and an error generation rate can be decreased.

In terms of power efficiency, the present disclosure includes an advantage in that system's power efficiency can be significantly increased by using a structure that may not include a Variable Gain Amplifier (VGA).

In terms of a structure, the present disclosure includes an advantage in that a beam width can be regulated by using a switch for operating a reflector and a director in several directions, and a beam can be generated in 360 degrees with one structure for sharing a feeder.

While the present disclosure includes been particularly shown and described with reference to example embodiments thereof, it will be understood by those skilled in the art that various changes in form and details may be made therein without departing from the spirit and scope of the present disclosure as defined by the appended claims.

What is claimed is:

1. An antenna apparatus for a wireless communication system, the antenna apparatus comprising:

a base;

an antenna module including a plurality of radiators, a plurality of directors, and a plurality of reflectors;

a controller configured to determine a beam direction of the antenna apparatus using first radiators of the plurality of radiators, first directors of the plurality of directors, and first reflectors of the plurality of reflectors; and a plurality of switching elements, wherein each of first switching elements of the plurality of switching elements is configured to connect to each of the first radiators, and wherein each of second switching elements of the plurality of switching elements is configured to connect to a floating metal module, each of second directors of the plurality of directors, and each of second reflectors of the plurality of reflectors, based on the beam direction determined by the controller, wherein the plurality of radiators are installed on the base in a radial shape.

2. The antenna apparatus of claim 1, wherein the antenna module comprises:

a radiator installed with a specific length and a specific diameter in a direction orthogonal to the base;

a reflector installed in parallel with the radiator to one side of the radiator; and at least one director installed with a specific interval in a direction facing the reflector with the radiator as its center on a straight line connecting the reflector and the radiator.

3. The antenna apparatus of claim 2, wherein the floating metal module comprises a unit floating metal which is connected to an upper portion of each of the second reflectors and each of the second directors.

4. The antenna apparatus of claim 3, wherein the unit floating metal of the floating metal module is formed to comprise a length longer than a length of the plurality of radiators when connected with the second reflectors and the second directors.

5. The antenna apparatus of claim 3, wherein the unit floating metal is installed on one metal plate together.

6. The antenna apparatus of claim 1, wherein when the second directors, the second reflectors, and the floating metal module are connected, radiation signals radiated by the first radiators are not induced in a direction thereof.

7. A method of controlling a beam for a wireless communication system, the method comprising:

determining a direction and width of the beam using first radiators of a plurality of radiators, first directors of a plurality of directors, and first reflectors of a plurality of reflectors;

connecting second reflectors of the plurality of reflectors and second directors of the plurality of directors to a floating metal module; and providing a signal to the first radiators, wherein the plurality of radiators are installed in a radial shape.

8. The method of claim 7, wherein the plurality of radiators, the plurality of reflectors, and the plurality of directors are included in an antenna apparatus comprising an antenna module.

9. The method of claim 8, wherein the antenna apparatus comprises:

a controller configured to determine a beam direction of the antenna apparatus; and a plurality of switching elements, wherein each of first switching elements of the plurality of switching elements is configured to connect to each of the first radiators, and wherein each of second switching elements of the plurality of switching elements is configured to connect to a floating metal module, each of second directors of the plurality of directors, and each of second reflectors of the plurality of reflectors, based on the beam direction determined by the controller.

10. The method of claim 9, wherein the antenna module comprises:

a radiator installed to comprise a specific length and a specific diameter in a direction orthogonal to a base;

a reflector installed in parallel with the radiator to one side of the radiator; and at least one director installed with a specific interval in a direction facing the reflector with the radiator as its center on a straight line connecting the reflector and the radiator.

11. The method of claim 10, wherein the floating metal module comprises a unit floating metal which is connected to an upper portion of each of the second reflectors and each of the second directors.

12. The method of claim 11, wherein the unit floating metal of the floating metal module is formed to comprise a length longer than a length of the plurality of radiators when connected with the second reflectors and the second directors.

13. The method of claim 11, wherein the corresponding unit floating metal is coupled to one metal plate together.

14. The method of claim 9, wherein when the second directors, the second reflectors, and the floating metal module are connected, radiation signals radiated by the first radiator are not induced in a direction thereof.

15. A user equipment, comprising:

a memory element;

a processor associated with the memory element, the processor configured to execute a set of instructions to:

determine a direction and width of a beam using first radiators of a plurality of radiators, first directors of a plurality of directors, and first reflectors of a plurality of reflectors;

connect second reflectors of the plurality of reflectors and second directors of the plurality of directors to a floating metal module; and provide a signal to the first radiators, wherein the plurality of radiators are installed in a radial shape.

16. The user equipment of claim 15, wherein the plurality of radiators, the plurality of reflectors, and the plurality of directors are included in an antenna apparatus comprising an antenna module.

* * * * *